US012420323B1

(12) United States Patent
Liu et al.

(10) Patent No.: US 12,420,323 B1
(45) Date of Patent: Sep. 23, 2025

(54) METHODS AND DEVICES FOR PREDICTING ROLLER GAPS IN NON-STEADY-STATE PROCESSES

(71) Applicant: TAIYUAN UNIVERSITY OF TECHNOLOGY, Shanxi (CN)

(72) Inventors: Yuanming Liu, Taiyuan (CN); Yiyang Zhang, Taiyuan (CN); Zhenhua Wang, Taiyuan (CN); Shuangchi Li, Taiyuan (CN); Yaxing Liu, Taiyuan (CN); Yipu Liu, Taiyuan (CN); Dongping He, Taiyuan (CN); Tao Wang, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 19/026,179

(22) Filed: Jan. 16, 2025

(30) Foreign Application Priority Data

Jun. 7, 2024 (CN) ..... 202410733601.7

(51) Int. Cl.
*B21B 37/58* (2006.01)

(52) U.S. Cl.
CPC ..... *B21B 37/58* (2013.01)

(58) Field of Classification Search
None
See application file for complete search history.

(56) References Cited

U.S. PATENT DOCUMENTS

2008/0127696 A1* 6/2008 Pawelski ..... B21B 37/00 72/11.1
2011/0030432 A1* 2/2011 Malik ..... B21B 37/28 700/148
2021/0362204 A1* 11/2021 Nikkuni ..... B21B 1/04

FOREIGN PATENT DOCUMENTS

CN 114722516 A 7/2022
CN 116078831 A 5/2023
(Continued)

OTHER PUBLICATIONS

Ren, Zhongkai et al., Research Progress and Prospects of Precision Ultra-thin Strip Rolling Theory, Journal of Mechanical Engineering, 2020, 12 pages.
(Continued)

*Primary Examiner* — Mohammad Ali
*Assistant Examiner* — Saad M Kabir
(74) *Attorney, Agent, or Firm* — PORUS IP LLC

(57) ABSTRACT

Provided are a method and a device for predicting a roller gap in a non-steady-state process. The method includes: obtaining a plurality of first rolling parameters; dividing, based on the plurality of first rolling parameters, a rolling deformation zone into an inlet elastic compression zone, a plastic deformation zone, and an outlet elastic recovery zone; determining a rolling force of the inlet elastic compression zone and a rolling force of the outlet elastic recovery zone through function calculations using a predetermined elastic mechanics calculation model; determining a rolling force of the plastic deformation zone through func-
(Continued)

tion calculations using a predetermined energy technique; determining, based on a coupling relationship between the rolling forces and a roller flattening radius, a first total rolling force of the non-steady-state process deformation zone that satisfies a predetermined convergence condition; obtaining the roller gap through function calculations using a first predetermined function model.

8 Claims, 7 Drawing Sheets

(56) References Cited

FOREIGN PATENT DOCUMENTS

| | | | |
|---|---|---|---|
| CN | 116371941 | A | 7/2023 |
| CN | 116371943 | A | 7/2023 |
| CN | 116984386 | A | 11/2023 |
| CN | 118023303 | A | 5/2024 |
| EP | 1466675 | A1 | 10/2004 |
| JP | H11123419 | A | 5/1999 |

OTHER PUBLICATIONS

He, Dongping et al., Review of Theoretical Studies on Vibration in Strip Rolling Mill, Journal of Mechanical Engineering, 60(7): 93-113, 2024.

He, Xinjun et al., Dynamic roll gap control technology based on force prediction model in segment, Steelmaking, 37 (5): 35-40, 2021.

Yehuda, Tamari et al., A Dynamic Method for Setting Roller Pumps Nonocclusively Reduces Hemolysis and Predicts Retrograde Flow, ASAIO Journal, 43(1): 39-52, 1997.

First Office Action in Chinese Application No. 202410733601.7 mailed on Jul. 10, 2024, 26 pages.

Notification to Grant Patent Right for Invention in Chinese Application No. 202410733601.7 mailed on Jul. 30, 2024, 4 pages.

* cited by examiner

METHODS AND DEVICES FOR PREDICTING ROLLER GAPS IN NON-STEADY-STATE PROCESSES

CROSS-REFERENCE TO RELATED APPLICATIONS

This application claims priority to Chinese Application No. 202410733601.7, filed on Jun. 7, 2024, the entire contents of which are incorporated herein by reference.

TECHNICAL FIELD

The present disclosure relates to the field of rolling technology, and in particular to a method and a device for predicting a roller gap in a non-steady-state process.

BACKGROUND

A key technological approach for the development of the steel industry is to reduce the waste of resources and energy. A new technology that has received widespread attention in the field of steel rolling is the energy-saving and material-saving technology of variable gauge rolling. The technical principle is to replace a traditional constant thickness slab with a variable thickness slab based on a working environment and forces borne by the slab, thereby saving materials and reducing the weight of finished products. As a result, variable thickness rolling products with increased thickness have been widely applied in fields such as automotive and construction. Variable gauge rolling with increasing thickness refers to a process where rollers possess both a rotational velocity and a vertical upward velocity during rolling, and a roller gap gradually increases during operation, allowing the slab to change from thin to thick. In the rolling process, the setting precision of the roller gap directly determines the thickness precision of a rolled product.

Currently, many researchers have made predictions regarding the roller gap during steady-state rolling processes and have achieved good technical results. However, few have focused on predicting the roller gap during a non-steady-state process with increased thickness. This is because, in non-steady-state rolling processes, the roller gap changes in real-time, and current technical solutions for predicting the roller gap in steady-state processes are not suitable for non-steady-state predictions. The few existing methods for predicting the roller gap in non-steady-state processes have a prediction accuracy of only around 95%, which is relatively low, making it difficult for the thickness precision of the rolled product to meet design requirements. Therefore, a new prediction method needs to be proposed to address the issue of low prediction accuracy for the roller gap in non-steady-state rolling processes.

SUMMARY

The purpose of the present disclosure is to provide a method and a device for predicting a roller gap in a non-steady-state process for solving the problem of low prediction accuracy of the roller gap in the non-steady-state rolling process.

In order to realize the above purposes, the present disclosure provides the following technical solutions:

One of the embodiments of the present disclosure provides a method for predicting a roller gap in a non-steady-state process. The method comprises: obtaining a plurality of first rolling parameters; dividing, based on the plurality of first rolling parameters, a rolling deformation zone into an inlet elastic compression zone, a plastic deformation zone, and an outlet elastic recovery zone using a predetermined rolling deformation zone division strategy; determining, based on the plurality of first rolling parameters, a rolling force of the inlet elastic compression zone and a rolling force of the outlet elastic recovery zone through function calculations using a predetermined elastic mechanics calculation model; determining, based on the plurality of first rolling parameters and a predetermined velocity field in a non-steady-state process deformation zone, a rolling force of the plastic deformation zone through function calculations using a predetermined energy technique; determining, based on the rolling force of the inlet elastic compression zone, the rolling force of the outlet elastic recovery zone, the rolling force of the plastic deformation zone, and a coupling relationship between the rolling forces and a roller flattening radius, a first total rolling force of the non-steady-state process deformation zone that satisfies a predetermined convergence condition. The method further comprises: obtaining a total rolling force of the non-steady-state process deformation zone by summing the rolling force of the inlet elastic compression zone, the rolling force of the outlet elastic recovery zone, and the rolling force of the plastic deformation zone; determining the roller flattening radius through a sixth predetermined function model based on the total rolling force of the non-steady-state process deformation zone and the plurality of first rolling parameters; determining, based on a roller flattening radius in an $i^{th}$ iteration and a roller flattening radius in a $(i-1)^{th}$ iteration, whether a logical relationship between the roller flattening radius in the $i^{th}$ iteration and the roller flattening radius in the $(i-1)^{th}$ iteration satisfies the predetermined convergence condition; in response to determining that the logical relationship between the roller flattening radius in the $i^{th}$ iteration and the roller flattening radius in the $(i-1)^{th}$ iteration satisfies the predetermined convergence condition, determining the total rolling force as the first total rolling force of the non-steady-state process deformation zone, wherein the roller flattening radius is determined through the following equation:

$$R = R_0\left[1 + \frac{1.7\times10^{-12}}{\pi w}\frac{P_{total}}{\left(\sqrt{T_{inlet} - T_{gap} + \Delta T_t} - \sqrt{T_{outlet} - T_{gap}}\right)^2}\right];$$

In the above equation, $P_{total}$ denotes the total rolling force of the non-steady-state process deformation zone, R denotes the roller flattening radius, $R_0$ denotes an original roller radius, w denotes one-half of a width 2w of a slab, $T_{inlet}$ denotes one-half of an inlet thickness $2T_{inlet}$ of the slab, Tap denotes one-half of a roller gap $2T_{gap}$, $T_{outlet}$ denotes one-half of an outlet thickness $2T_{outlet}$ of the slab, and $\Delta T_t$ denotes an effect of a front tension and a back tension on the roller flattening radius. The method further comprises: obtaining, based on the plurality of first rolling parameters and the first total rolling force, the roller gap through function calculations using a first predetermined function model, wherein the roller gap is a roller gap taking into account a stiffness of a rolling mill, and the first predetermined function model includes the following equation:

$$S_{gap} = 2T_{gap} - \frac{P'_{total}}{K}$$

In the above equation, $S_{gap}$ denotes the roller gap taking into account the stiffness of the rolling mill, $2T_{gap}$ denotes the roller gap, $$P'_{total}$$

denotes the first total rolling force, and $P_{total}$ denotes the stiffness of the rolling mill.

One of the embodiments of the present disclosure provides a device for predicting a roller gap in a non-steady-state process. The device comprises an acquisition module, a zone division module, a first determination module, a second determination module, a third determination module, and an obtaining module. The acquisition module is configured to obtain a plurality of first rolling parameters. The zone division module is configured to divide, based on the plurality of first rolling parameters, a rolling deformation zone into an inlet elastic compression zone, a plastic deformation zone, and an outlet elastic recovery zone using a predetermined rolling deformation zone division strategy. The first determination module is configured to determine, based on the plurality of first rolling parameters, a rolling force of the inlet elastic compression zone and a rolling force of the outlet elastic recovery zone through function calculations using a predetermined elastic mechanics calculation model. The second determination module is configured to determine, based on the plurality of first rolling parameters and a predetermined velocity field in a non-steady-state process deformation zone, a rolling force of the plastic deformation zone through function calculations using a predetermined energy technique. The third determination module is configured to determine, based on the rolling force of the inlet elastic compression zone, the rolling force of the outlet elastic recovery zone, the rolling force of the plastic deformation zone, and a coupling relationship between the rolling forces and a roller flattening radius, a first total rolling force of the non-steady-state process deformation zone that satisfies a predetermined convergence condition. To determine the first total rolling force of the non-steady-state process deformation zone that satisfies the predetermined convergence condition, the third determination module is further configured to: obtain a total rolling force of the non-steady-state process deformation zone by summing the rolling force of the inlet elastic compression zone, the rolling force of the outlet elastic recovery zone, and the rolling force of the plastic deformation zone; determine the roller flattening radius through a sixth predetermined function model based on the total rolling force of the non-steady-state process deformation zone and the plurality of first rolling parameters; determine, based on a roller flattening radius in an $i^{th}$ iteration and a roller flattening radius in a $(i-1)^{th}$ iteration, whether a logical relationship between the roller flattening radius in the $i^{th}$ iteration and the roller flattening radius in the $(i-1)^{th}$ iteration satisfies the predetermined convergence condition; in response to determining that the logical relationship between the roller flattening radius in the $i^{th}$ iteration and the roller flattening radius in the $(i-1)^{th}$ iteration satisfies the predetermined convergence condition, determining the total rolling force as the first total rolling force of the non-steady-state process deformation zone, wherein the roller flattening radius is determined through the following equation:

$$R = R_0\left[1 + \frac{1.7\times10^{-12}}{\pi w}\frac{P_{total}}{\left(\sqrt{T_{inlet} - T_{gap} + \Delta T_t} - \sqrt{T_{outlet} - T_{gap}}\right)^2}\right]$$

In the above equation, $P_{total}$ denotes the total rolling force of the non-steady-state process deformation zone, R denotes the roller flattening radius, $R_0$ denotes an original roller radius, w denotes one-half of a width 2w of a slab, $T_{inlet}$ denotes one-half of an inlet thickness $2T_{inlet}$ of the slab, $T_{gap}$ denotes one-half of a roller gap $2T_{gap}$, $T_{outlet}$ denotes one-half of an outlet thickness $2T_{outlet}$ of the slab, and $\Delta T_t$ denotes an effect of a front tension and a back tension on the roller flattening radius. The obtaining module is configured to obtain, based on the plurality of first rolling parameters and the first total rolling force, the roller gap through function calculations using a first predetermined function model, wherein the roller gap is a roller gap taking into account a stiffness of a rolling mill, and the first predetermined function model includes the following equation:

$$S_{gap} = 2T_{gap} - \frac{P'_{total}}{K}$$

In the above equation, $S_{gap}$ denotes the roller gap taking into account the stiffness of the rolling mill, $2T_{gap}$ denotes the roller gap, $$P'_{total}$$

denotes the first total rolling force, and $$P'_{total}$$

denotes the stiffness of the rolling mill.

BRIEF DESCRIPTION OF THE DRAWINGS

The accompanying drawings illustrated herein are used to provide a further understanding of the present disclosure, forming a part of the present disclosure. The schematic embodiments of the present disclosure and their illustrations are used to explain the present disclosure and do not constitute an undue limitation of the present disclosure. In the accompanying drawings.

DETAILED DESCRIPTION

In order to facilitate a clear description of the technical solutions of the embodiments in the present disclosure, in the embodiments of the present disclosure, words such as "first", "second" and the like are used to differentiate between identical or similar items that have essentially the same function and role. For example, the first threshold value and the second threshold value are merely for distinguishing between different thresholds and do not qualify their order of precedence. A person skilled in the art may understand that the words "first", "second", etc., do not have any effect on the quantity and execution order of the first threshold. The words "first", "second", etc., do not qualify the number and order of execution, and the words "first", "second", etc., do not qualify that they are necessarily different.

Many researchers have predicted roller gaps during steady-state rolling processes, but very few have attempted to predict roller gaps during non-steady-state processes where thickness increases. This is because roller gaps change in real-time during non-steady-state rolling processes. Current technical solutions for predicting roller gaps in steady-state rolling processes are not suitable for predicting roller gaps in non-steady-state rolling processes. The existing few methods for predicting roller gaps in non-steady-state processes tend to have low accuracy, with prediction accuracy typically around 95%. Since the precision of roller gap settings directly determines the thickness accuracy of a rolled product, improving the prediction accuracy of roller gaps during thickness-increasing non-steady-state processes is a pressing issue to improve the thickness accuracy of the rolled product and meet design requirements.

Figure 1:
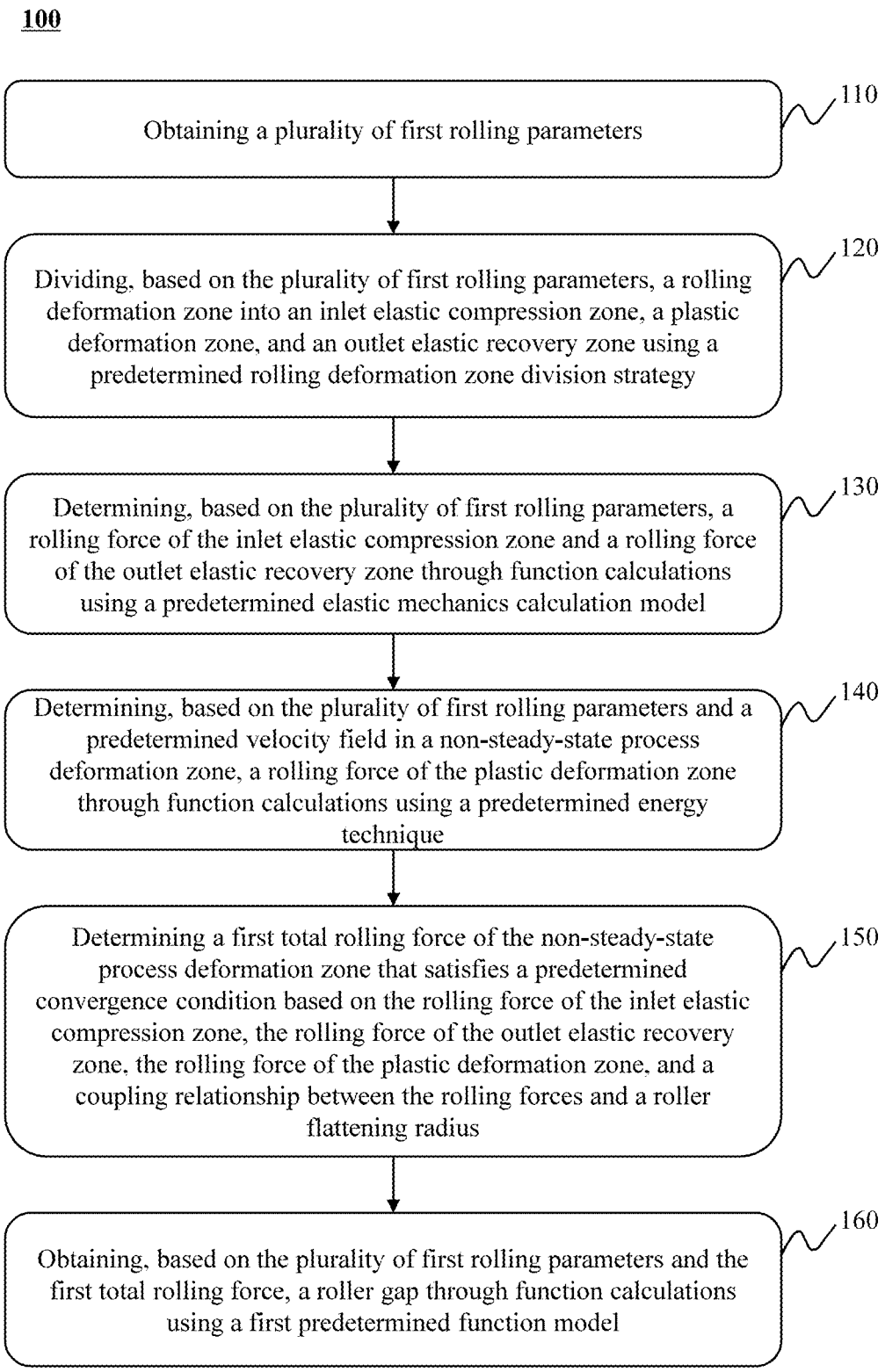
FIG. 1 is a flowchart of an exemplary process for predicting a roller gap in a non-steady-state process according to some embodiments of the present disclosure.

In view of this, the present disclosure provides a method for predicting a roller gap in a non-steady-state process. The method can increase the prediction accuracy of roller gaps to over 98%, thus addressing the low prediction accuracy problem of roller gaps during non-steady-state rolling processes. The following description of the technical solution is provided in conjunction with the accompanying drawings:

Referring to FIG. 1. FIG. 1 is a flowchart of an exemplary process for predicting a roller gap in a non-steady-state process according to some embodiments of the present disclosure. The subject of execution thereof is at least one of a terminal or a server equipped with the embodiments disclosed herein, such as a rolling device or a server capable of remotely controlling the rolling device.

The rolling device refers to mechanical equipment used for the pressure processing of metals.

The terminal refers to one or more terminal devices that interact with the rolling device. For example, the terminal may be a constituent part of the rolling device. The terminal may be one of a mobile device, a computer, or other devices having input and/or output functions, or any combination thereof. For example, the terminal may be the rolling device, etc.

The server manages resources and processes data and/or information from at least one component of a device for predicting the roller gap in the non-steady-state process or an external data source (e.g., a cloud data center). In some embodiments, the server is a single server or a server group. The server group may be centralized or distributed (e.g., the servers are part of a distributed system), and may be dedicated or provide services concurrently with other devices or systems. In some embodiments, the server is local or remote.

In some embodiments, the server is a constituent part of the rolling device.

As shown in FIG. 1, the method for predicting the roller gap in the non-steady-state process includes the following operations:

In 110, obtaining a plurality of first rolling parameters.

The first rolling parameters refer to initial parameters that are used to initialize a rolling setup, guide a rolling process, and affect a size, a shape, and a performance of a final product during the rolling process.

In some embodiments, in operation 110, the plurality of first rolling parameters includes initial parameters such as an original thickness 2T of a slab, an inlet thickness $2T_{inlet}$ of the slab, a width 2w of the slab, a thickness $2T_{thick}$ of a product thick zone, a thickness $2T_{thin}$ of a product thin zone, a length L of a product transition zone, a front tension $F_{front}$ of the slab and a back tension $F_{back}$ of the slab during rolling, and a rotation velocity n of rollers, a vertical velocity V of the rollers, an original roller flattening radius $R_0$, an elastic modulus $E_s$ of the slab, a coefficient of friction f between the rollers and the slab, or the like.

The original thickness 2T of the slab refers to an initial unprocessed thickness of the slab prior to rolling. The inlet thickness $2T_{inlet}$ of the slab refers to a thickness of the slab at the time the slab enters the rolling device. The width 2w of the slab refers to a width dimension of the slab. The thickness $2T_{thick}$ of the product thick zone refers to a thickness of a relatively thick zone of a product. The thickness $2T_{thin}$ of the product thin zone refers to a thickness of a relatively thin zone of the product. The length L of the product transition zone refers to a length of a transition zone of the product from the thick zone to the thin zone. The front tension $F_{front}$ refers to a tension applied at an exit of a deformation zone of the slab, acting in a same direction as a rolling direction. The back tension $F_{back}$ refers to the tension applied at an entrance of the deformation zone of the slab, acting in an opposite direction to the rolling direction. The rotation velocity n of the rollers (also referred to as a velocity of the rollers) refers to a velocity of rotation of the rollers. The vertical velocity V of the rollers refers to a velocity at which the rollers move in a vertical direction. The original roller flattening radius $R_0$ refers to a radius of the rollers in their initial state (e.g., when the rollers are not flattened, etc.). The elastic modulus $E_s$ of the slab refers to an elastic modulus of a material of the slab, reflecting material's ability to resist elastic deformation. The coefficient of friction f between the rollers and the slab refers to a coefficient of friction between contact surfaces of the rollers and the slab.

In some embodiments, the server may determine parameters obtained after measurement or calculation as the first rolling parameters. For example, the server obtains the original thickness 2T of the slab by a sensor, a thickness gauge, or the like. As another example, the server may obtain the rotation velocity n of the rollers via a velocity sensor, an inverter, or the like. More descriptions regarding determining the first rolling parameters may be found in the FIGS. 2*a*-2*b* and their related descriptions.

In 120, dividing, based on the plurality of first rolling parameters, a rolling deformation zone into an inlet elastic compression zone, a plastic deformation zone, and an outlet elastic recovery zone through a predetermined rolling deformation zone division strategy.

The predetermined rolling deformation zone division strategy refers to an approach for reasonably dividing different stages of material deformation in the rolling process based on properties of a material, requirements of the rolling process, and characteristics of the rolling device. In some embodiments, the predetermined rolling deformation zone division strategy is set by a technical professional or by system default.

The rolling deformation zone refers to a zone where the slab undergoes deformation under an action of a rolling force during the rolling process.

The inlet elastic compression zone refers to a zone where the material just enters the rolling mill and undergoes only elastic compression under the action of the rolling force.

The plastic deformation zone refers to a zone where the material undergoes permanent plastic deformation after exceeding an elastic limit during rolling.

The outlet elastic recovery zone refers to a zone area where the slab, after leaving the rolling mill, has already undergone plastic deformation, and due to the reduction of the rolling force, no longer undergoes plastic deformation but only experiences elastic deformation.

In some embodiments, in operation 120, the server obtains a stress-strain curve of the material via an electronic universal testing machine, or the like. The server fits the stress-strain curve to obtain a deformation resistance model for the material. The server divides the rolling deformation zone into the inlet elastic compression zone I, the plastic deformation zone II, and the outlet elastic recovery zone III according to the predetermined rolling deformation zone division strategy.

In some embodiments, the server determines, based on the plurality of first rolling parameters, a compressed thickness $2\Delta T_{inlet}$ of the inlet elastic compression zone and a recovered thickness $2\Delta T_{outlet}$ of the outlet elastic recovery zone. For example, the server determines the compressed thickness $2\Delta T_{inlet}$ of the inlet elastic compression zone and the recovered thickness $2\Delta T_{outlet}$ of the outlet elastic recovery zone using predetermined equations. The predetermined equations may include Equation (5) and Equation (6). More descriptions of Equation (5) and Equation (6) may be found in the relevant descriptions below.

The compressed thickness $2\Delta T_{inlet}$ of the inlet elastic compression zone refers to an amount of elastic compression that occurs due to the rolling force exerted on the slab in the inlet elastic compression zone during the rolling process.

The recovered thickness $2\Delta T_{outlet}$ of the outlet elastic recovery zone refers to an amount of elastic recovery that occurs due to the release of the rolling force on the slab in the outlet elastic recovery zone during the rolling process.

In 130, determining, based on the plurality of first rolling parameters, a rolling force of the inlet elastic compression zone and a rolling force of the outlet elastic recovery zone through function calculations using a predetermined elastic mechanics calculation model.

The predetermined elastic mechanics calculation model refers to a mathematical function used to analyze and compute stress, strain, and deformation of a material when it is subjected to an external force in an elastic range. In some embodiments, the predetermined elastic mechanics calculation model includes but is not limited to, a second predetermined function mode and a third predetermined function model.

The second predetermined function model and the third predetermined function model are models predetermined for determining relevant parameters. More descriptions of the second predetermined function model may be found in Equation (14), Equation (15), and Equation (16) below and their related descriptions. More descriptions of the third predetermined function model may be found in Equation (17) and Equation (18) below and their related descriptions.

The rolling force of the inlet elastic compression zone refers to a force exerted by the rolls on the slab, causing the material to undergo elastic deformation in the inlet elastic compression zone.

The rolling force of the outlet elastic recovery zone refers to a force exerted by the rolls on the slab, causing the material to undergo elastic deformation in the outlet elastic recovery zone.

In some embodiments, the server may determine the rolling force of the inlet elastic compression zone and the rolling force of the outlet elastic recovery zone in a variety of ways.

In some embodiments, the server may determine the rolling force of the inlet elastic compression zone using the second predetermined function model based on the plurality of first rolling parameters, a first angle, and a first contact angle. For example, the server may determine the rolling force of the inlet elastic compression zone through predetermined equations. The predetermined equations include Equation (16), and more descriptions of Equation (16) may be found in the related description below. In some embodiments, the server may also determine the rolling force of the inlet elastic compression zone based on any other feasible means (e.g., function modeling, etc.).

In some embodiments, the server may determine the rolling force of the inlet elastic compression zone using predetermined equation by taking into account an effect of tension on the inlet elastic recovery zone. The predetermined equation includes Equation (49), and more descriptions of Equation (49) may be found in the related description below.

In some embodiments of the present disclosure, the server determines the rolling force of the outlet elastic recovery zone using the third predetermined function model based on the plurality of first rolling parameters as well as a first recovery height. For example, the server determines the rolling force of the outlet elastic recovery zone by predetermined equations. The predetermined equation includes Equation (18), and more descriptions of Equation (18) may be found in the related description below.

In some embodiments of the present disclosure, the server may determine the rolling force of the outlet elastic recovery zone using a predetermined equation by taking into account an effect of tension on the outlet elastic recovery zone. The predetermined equation may include Equation (51), and more descriptions of Equation (51) may be found in the related description below.

In 140, determining, based on the plurality of first rolling parameters and a predetermined velocity field in a non-steady-state process deformation zone, a rolling force of the plastic deformation zone through function calculations using a predetermined energy technique.

The predetermined energy technique refers to functions used to determine relevant parameters (e.g., the rolling force of the plastic deformation zone, an inlet unit flow rate per second, etc.). For example, the predetermined energy technique includes, but is not limited to, a fourth predetermined function model and a fifth predetermined function model.

The non-steady-state process deformation zone is also referred to as the rolling deformation zone. More descriptions of the rolling deformation zone may be found in the related descriptions above.

The velocity field refers to a distribution of the rolling velocity of the material at each point (e.g., physical position point) in the non-steady-state process deformation zone. For example, the velocity field is represented by a mathematical function or a vector field.

The rolling force of the plastic deformation zone refers to a force exerted by the rolls on the slab in the plastic deformation zone, causing the material to undergo plastic deformation.

In some embodiments of the present disclosure, the server determines the rolling force of the plastic deformation zone in a variety of ways.

In some embodiments of the present disclosure, the server may determine the rolling force of the plastic deformation zone based on a corresponding relationship between a total power functional and the rolling force. For example, the server may determine the rolling force of the plastic deformation zone by a predetermined equation. The predetermined equation includes Equation (28), and more descriptions of Equation (28) may be found in the following description. In some embodiments of the present disclosure, the server also determines the rolling force of the plastic deformation zone based on any other feasible means (e.g., functional modeling, etc.).

In 150, determining, based on the rolling force of the inlet elastic compression zone, the rolling force of the outlet elastic recovery zone, the rolling force of the plastic deformation zone, and a coupling relationship between the rolling forces and a flattening radius, a first total rolling force of the non-steady-state process deformation zone that satisfies a predetermined convergence condition.

The flattening radius (also referred to as a roller flattening radius) refers to a radius resulting from the radial deformation of the rollers caused by the action of the rolling force during the rolling process.

In some embodiments of the present disclosure, the server obtains the roller flattening radius via a sixth predetermined function model. For example, the server may determine the roller flattening radius by a predetermined equation. The predetermined equation includes Equation (30), and more descriptions of Equation (30) may be found in the related description below. In some embodiments of the present disclosure, the server may also determine the roller flattening radius based on any other feasible means (e.g., function modeling, etc.).

The coupling relationship refers to an interactive and mutually influencing relationship between the flattening radius of the roller and the rolling force of the aforementioned inlet elastic compression zone, the rolling force of the outlet elastic recovery zone, and the rolling force of the plastic deformation zone.

In some embodiments of the present disclosure, the server determines the coupling relationship through experimental data, numerical simulations, or the like.

The predetermined convergence condition refers to guidelines for determining whether the roller flattening radius is stable and reliable. For example, the predetermined convergence condition includes, but is not limited to, a change in the roller flattening radius in successive iterations being less than a predetermined threshold, etc.

The first total rolling force refers to a sum of the rolling force of the aforementioned inlet elastic compression zone, the rolling force of the outlet elastic recovery zone, and the rolling force of the plastic deformation zone.

In some embodiments, in response to the roller flattening radius satisfying the predetermined convergence condition, the server sums the rolling force of the inlet elastic compression zone, the rolling force of the outlet elastic recovery zone, and the rolling force of the plastic deformation zone to obtain the total rolling force of the non-steady-state process deformation zone. More descriptions of this embodiment may be found in Equation (29) and Equation (32) and their related descriptions.

In some embodiments, the server sums the rolling force of the inlet elastic compression zone, the rolling force of the outlet elastic recovery zone, and the rolling force of the plastic deformation zone to obtain the total rolling force of the non-steady-state process deformation zone. The server determines the roller flattening radius using the sixth predetermined function model based on the total rolling force of the non-steady-state process deformation zone and the plurality of first rolling parameters. The server determines, based on a roller flattening radius in an $i^{th}$ iteration and a roller flattening radius in a $(i-1)^{th}$ iteration, whether a logical relationship between the roller flattening radius in the $i^{th}$ iteration and the roller flattening radius in the $(i-1)^{th}$ iteration meets the predetermined convergence condition. In response to determining that the logical relationship satisfies the predetermined convergence condition, the server determines the total rolling force as the first total rolling force of the non-steady-state process deformation zone. More descriptions of this embodiment may be found in the related description below.

In 160, obtaining, based on the plurality of first rolling parameters and the first total rolling force, the roller gap through function calculations using a first predetermined function model.

The first predetermined function model refers to a predetermined correlation function for calculating the roller gap. For example, the first predetermined function model may include Equation (33) and Equation (65). More descriptions of Equation (33) and Equation (65) may be found in the relevant description below.

The roller gap (also referred to as a roller gap of the rollers) refers to a gap between two rollers during the rolling process.

In some embodiments, the server determines the roller gap based on predetermined equations. The predetermined equations include Equation (7), Equation (33), and Equation (65). More descriptions of Equation (7), Equation (33), and Equation (65) may be found in the related descriptions below.

In some embodiments, in the operations 130 to 160, the server performs function calculations based on the first rolling parameters, using the predetermined elastic mechanics calculation model to determine the rolling force $$P^{e}_{inlet}$$

of the inlet elastic compression zone and the rolling force $$P^{e}_{outlet}$$

of the outlet elastic recovery zone.

In some embodiments, the server establishes a velocity relationship based on characteristics of the non-steady-state process deformation zone, and determines the rolling force $P_{plastic}$ of the plastic deformation zone using a predetermined energy technique. For example, the velocity relationship is established based on the characteristics of the non-steady-state process deformation zone during cold rolling thickness increase. The server obtains the first total rolling force of the non-steady-state process deformation zone that meets the predetermined convergence condition based on the rolling force $$P^{e}_{inlet}$$

of the elastic compression zone, the rolling force $$P^{e}_{outlet}$$

of the outlet elastic recovery zone, and the rolling force $P_{plastic}$ of the plastic deformation zone. The server further performs function calculations using the first predetermined function model based on the plurality of first rolling parameters and the first total rolling force, thereby obtaining predicted data for the roller gap in the non-steady-state process.

In some embodiments, based on experimental validation, using the method disclosed in the present disclosure for predicting the roller gap in the non-steady-state process, the prediction accuracy of the roller gap can be increased to more than 98%, substantially increasing the prediction accuracy of the roller gap in the non-steady-state process, and the thickness accuracy of the roller products is further improved.

In some embodiments of the present disclosure, the prediction of the roller gap in the non-steady-state process is performed through the method described from operation 110 to operation 160, such as predicting the roller gap during non-steady-state cold rolling processes with increased thickness. The real-time predicted roller gap obtained is closer to the on-site measured values, addressing the issue of rolling force prediction under different production processes. Moreover, the method disclosed in the embodiments of the present disclosure features short computation time and high accuracy, making it applicable to the prediction of roller gaps during non-steady-state cold rolling processes with increased thickness. This not only reduces investment costs but also improves the accuracy of the product's shape and thickness.

Figure 2A:
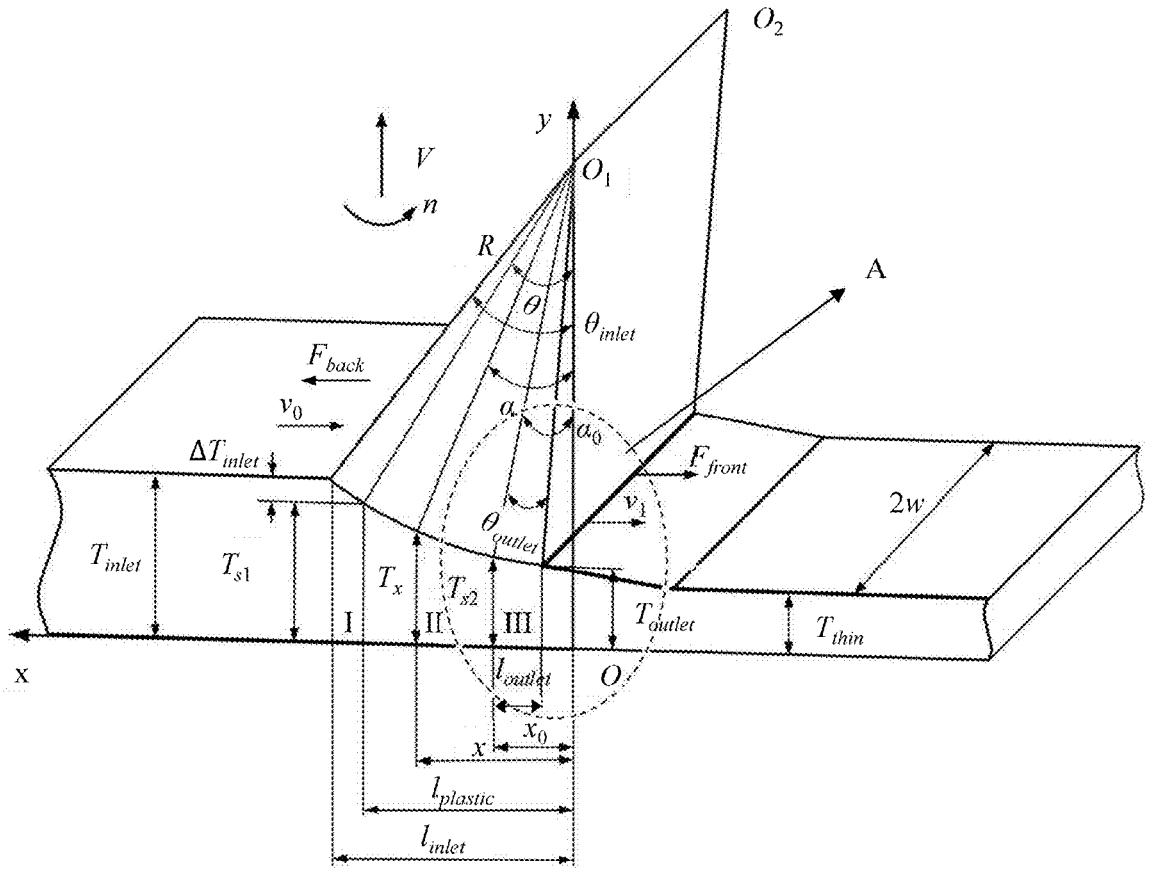
FIG. 2*a* is a schematic diagram of half of a structure of a deformation zone in a non-steady-state process of cold rolling thickness increase, based on a method for predicting a roller gap in the non-steady-state process, according to some embodiments of the present disclosure.
Figure 2B:
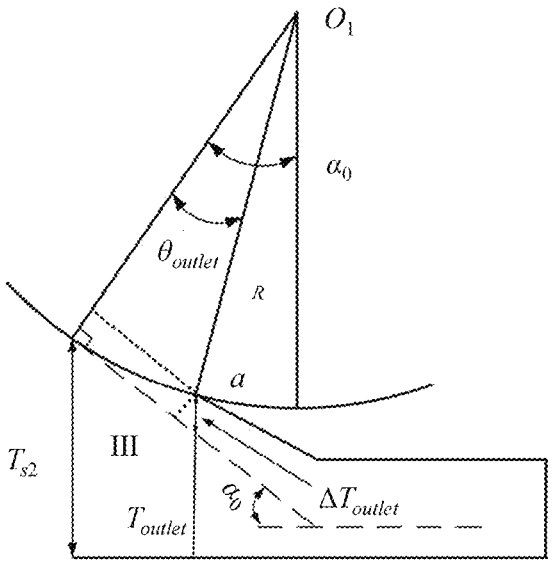
FIG. 2*b* is an enlarged schematic diagram of a structure corresponding to position A in FIG. 2*a* according to some embodiments of the present disclosure.

In some embodiments, in operation 110, the initial parameters as well as the parameters obtained by measuring or performing calculations by a relevant device (e.g., a sensor, etc.) may include all of the parameters in FIG. 2*a* and FIG. 2*b*.

FIG. 2*a* is a schematic diagram of half of a structure of a deformation zone in a non-steady-state process of cold rolling thickness increase, based on a method for predicting a roller gap in the non-steady-state process, according to some embodiments of the present disclosure.

FIG. 2*b* is an enlarged schematic diagram of a structure corresponding to position A in FIG. 2*a* according to some embodiments of the present disclosure. The parameters obtained through measurement by relevant equipment or simple calculations may include the following:

(A). A time $t_{transition}$ of a transition zone in the non-steady-state process of cold rolling thickness increase, an inclination angle $\gamma$ of the transition zone, an outlet thickness $2T_{outlet}$ of an outlet elastic recovery zone at any time t are determined based on a dimension of a rolled product and a velocity of rollers. The any time t refers to any time in the rolling process.

The time $t_{transition}$ of the transition zone of the non-steady-state process refers to a duration from the start to the end of the unsteady rolling process.

The inclination angle $\gamma$ of the transition zone refers to an angle between a slop of the transition zone and a horizontal direction.

The outlet thickness $2T_{outlet}$ of the outlet elastic recovery zone (also referred to as an outlet thickness of a slab) refers to a distance between upper and lower surfaces of the slab at an outlet position of the deformation zone.

As an example, the server uses Equation (1), Equation (2), and Equation (3) to determine the time $t_{transition}$ of the transition zone of the non-steady-state process, the inclination angle $\gamma$ of the transition zone, and the outlet thickness $2T_{outlet}$ of the outlet elastic recovery zone at any time t, respectively:

$$t_{transition} = \frac{T_{thick} - T_{thin}}{V} \tag{1}$$

$$\tan\gamma = \frac{T_{thick} - T_{thin}}{L} \tag{2}$$

$$T_{outlet} = T_{thin} + Vt \tag{3}$$

In the above equations, $2T_{thick}$ denotes a thickness of a product thick zone, $2T_{thin}$ denotes a thickness of a product thin zone, V denotes a vertical velocity of the rollers, and L denotes a length of a product transition zone.

Descriptions of the thickness of the product thick zone, the thickness of the product thin zone, the vertical velocity of the rollers, and the length of the product transition zone may be found in FIG. 1 and the related descriptions thereof.

It should be noted that the rolling parameters, such as $T_{thick}$ and $T_{thin}$, shown in the equations disclosed in the embodiments of the present disclosure, $T_{thick}$ is one-half of the thickness $2T_{thick}$ of the product thick zone, $T_{thin}$ is one-half of the thickness $2T_{thin}$ of the product thin zone, and $T_{outlet}$ is one-half of the outlet thickness $2T_{outlet}$ of the outlet elastic recovery zone at any time t. In the function equations disclosed in the embodiments of the present disclosure, any expressions similar to those shown in Equations (1) to (3) indicate that during calculations, the values corresponding to the rolling parameters are taken as one-half for the corresponding functional calculation.

(B) A material stress-strain curve is obtained based on an electronic universal testing machine, and the curve is fitted to obtain a deformation resistance model for the material.

As an example, the server calculates a deformation resistance of the material 8, using Equation (4):

$$\delta_s = A_0 \varepsilon^{A_1} \tag{4}$$

The deformation resistance model is fitted. $\delta_s$ denotes the deformation resistance of the material, $A_0$ and $A_1$ are nonlinear regressive coefficients, which are related to the material's properties and may be set by a professional technician or by system default, and $\varepsilon$ denotes an engineering strain of the material.

The deformation resistance $\delta_s$ of the material refers to a force that resists deformation within the material when the material undergoes plastic deformation. For example, the deformation resistance $\delta_s$ of the material is commonly expressed in terms of stress, with units in Pascals (Pa) or megapascals (MPa).

The engineering strain ε of the material refers to a ratio of a change of a length of the material when subjected to a force to an original length of the material.

In some embodiments, the engineering strain ε of the material is obtained experimentally by a person of specialized skill.

(C). Based on characteristics of a rolling deformation zone, the rolling deformation zone is divided into an inlet elastic compression zone I, a plastic deformation zone II, and an outlet elastic recovery zone III, and a compressed thickness $2\Delta T_{inlet}$ of the inlet elastic compression zone and a recovered thickness $2\Delta T_{outlet}$ of the outlet elastic recovery zone are determined.

As an example, the server uses Equation (5) and Equation (6) to calculate one-half of the compressed thickness $2\Delta T_{inlet}$ of the inlet elastic compression zone and one-half of the recovered thickness $2\Delta T_{outlet}$ of the outlet elastic recovery zone, respectively:

$$\Delta T_{Inlet} = \frac{T_{inlet}}{E_s}\left[(1-v_s^2)\delta_{s0} - \frac{(1+v_s)v_s F_{back}}{4T_{inlet}w}\right] \tag{5}$$

$$\Delta T_{outlet} = \frac{T_{outlet}}{E_s}\left[(1-v_s^2)A_0\left(\frac{T-T_{outlet}}{T}\right)^{A_1} - \frac{(1+v_s)v_s F_{front}}{4T_{outlet}w}\right] \tag{6}$$

In the above equations, $E_s$ denotes an elastic modulus of a slab, $v_s$ denotes a Poisson's ratio of the slab, $2T_{inlet}$ denotes an inlet thickness of the slab, $\delta_{s0}$ denotes a yield strength of the material, 2T denotes an original thickness of the slab, $2T_{outlet}$ denotes the outlet thickness of the slab, 2w denotes a width of the slab, $F_{front}$ denotes a front tension of the slab, and $F_{back}$ denotes a back tension of the slab.

The Poisson's ratio $v_s$ of the slab refers to a ratio of a transverse strain to a longitudinal strain when the slab is subjected to tension or compression.

The yield strength $\delta_{s0}$ of the material refers to a minimum stress at which the material begins to undergo plastic deformation when subjected to an external force, which is an important measure of the material's ability to resist plastic deformation.

In some embodiments, the Poisson's ratio $v_s$ of the slab and the yield strength $\delta_{s0}$ of the material are set by a professional technician or by system default.

More descriptions of the elastic modulus of the slab, the inlet thickness of the slab, the original thickness of the slab, the outlet thickness of the slab, the width of the slab, the front tension of the slab, and the back tension of the slab may be found in FIG. 1 and the related descriptions thereof.

(D). Based on a roller flattening radius and the outlet thickness of the slab, a roller gap $2T_{gap}$, a thickness $2T_x$ corresponding to any position of the deformation zone, an angle $\alpha_0$ corresponding to a distance from an outlet position of the plastic deformation zone to a roller centerline, and an angle $\theta_{outlet}$ corresponding to the outlet elastic recovery zone are determined.

The thickness $2T_x$ corresponding to any position of the deformation zone refers to a thickness of the material at a specific position in the deformation zone (usually along the rolling direction) during the rolling process.

The angle $\alpha_0$ corresponding to the distance from the outlet position of the plastic deformation zone to the roller centerline refers to an angle corresponding to the distance from the outlet position of the plastic deformation zone to the roller centerline (i.e., the line connecting the centers of two rollers).

The angle $\theta_{outlet}$ corresponding to the outlet elastic recovery zone refers to an angle corresponding to a horizontal distance from the outlet position of the plastic deformation zone to the outlet position of the elastic recovery zone.

More descriptions of the roller gap $2T_{gap}$ may be found in FIG. 1 and its related description.

As an example, the server calculates one-half of the roller gap $2T_{gap}$, one-half of the thickness $2T_x$ corresponding to any position of the deformation zone, the angle do corresponding to the distance from the outlet position of the plastic deformation zone to the roller centerline, and the angle $\theta_{outlet}$ corresponding to the outlet elastic recovery zone, respectively, using the following equations:

$$T_{gap} = T_{outlet} + R\cos(\alpha_0 - \Theta_{outlet}) - R \tag{7}$$

$$T_x = R + T_{gap} - \sqrt{R^2 - x^2} \tag{8}$$

$$\theta_{oulet} = \arcsin\sqrt{\frac{2R\Delta T_{outlet}\cos\alpha_0}{R}} \tag{9}$$

$$\alpha_0 = \arctan\left\{\frac{\frac{1}{L}\left\{T_{thick} - \frac{T_{thick}}{E_s}\left[(1-v_s^2)\delta_{s0} - \frac{(1+v_s)v_s F_{back}}{4T_{inlet}w}\right]\right\} - \frac{1}{L}\left\{T_{thin} - \frac{T_{thin}}{E_s}\left[(1-v_s^2)A_0\left(\frac{T-T_{outlet}}{T}\right)^{A_1} - \frac{(1+v_s)v_s F_{front}}{4T_{outlet}w}\right]\right\}}{}\right\} \tag{10}$$

In the above equations, $2T_{outlet}$ denotes the outlet thickness of the slab, R denotes the roller flattening radius, $2T_{gap}$ denotes the roller gap, L denotes the length of the product transition zone, $2T_{thick}$ denotes the thickness of the product thick zone, $\delta_{s0}$ denotes the yield strength of the material, $E_s$ denotes the elastic modulus of the slab, $v_s$ denotes the Poisson's ratio of the slab, $A_0$ and $A_1$ are nonlinear regressive coefficients, which are related to the properties of the material, $2T_{inlet}$ denotes the inlet thickness of the slab, 2T denotes the original thickness of the slab, 2w denotes the width of the slab, $F_{front}$ denotes the front tension of the slab, $F_{back}$ denotes the back tension of the slab, $2T_{thin}$ denotes the thickness of the product thin zone, and $2\Delta T_{outlet}$ denotes the recovered thickness of the outlet elastic recovery zone.

(E). Based on the rolling process parameters, a distance $l_{inlet}$ from an inlet position of the inlet elastic compression zone I to the roller centerline, a distance $l_{plastic}$ from an inlet position of the plastic deformation zone II to the roller centerline, and a projected contact arc length $l_{outlet}$ of the outlet elastic recovery zone III in the rolling direction are determined.

The distance $l_{inlet}$ from the inlet position of the inlet elastic compression zone I to the roller centerline refers to a distance from a point in the rolling process where the slab begins to be subjected to the rolling force and undergoes elastic deformation to the roller centerline (the line connecting the centers of two rollers).

The distance $l_{plastic}$ from the inlet position of the plastic deformation zone II to the roller centerline refers to a distance from the inlet position (i.e., the point where the slab begins to undergo plastic deformation) of the plastic deformation zone to the roller centerline.

The projected contact arc length $l_{outlet}$ of the outlet elastic recovery zone III in the rolling direction refers to a projected length of an arc where the material contacts the rollers in the outlet elastic recovery zone, along the rolling direction.

As an example, the server may calculate the distance $l_{inlet}$ from the inlet position of the inlet elastic compression zone I to the roller centerline, the distance $l_{plastic}$ from the inlet position of the plastic deformation zone II to the roller centerline, and the projected contact arc length $l_{outlet}$ of the outlet elastic recovery zone III in the rolling direction using the following equations, respectively:

$$l_{inlet}=\sqrt{2R(T_{\text{inlet}}-T_{\text{gap}})-(T_{\text{inlet}}-T_{\text{gap}})^2} \tag{11}$$

$$l_{plastic}=\sqrt{2R(T_{s1}-T_{\text{gap}})-(T_{s1}-T_{\text{gap}})^2} \tag{12}$$

$$l_{plastic}=\sqrt{2R(T_{s2}-T_{\text{gap}})-(T_{s2}-T_{\text{gap}})^2}-\sqrt{2R(T_{\text{outlet}}-T_{\text{gap}})-(T_{\text{outlet}}-T_{\text{gap}})^2} \tag{13}$$

In the above equations, $2T_{s1}$ denotes an inlet thickness of the plastic deformation zone, $T_{s1}=T_{inlet}-\Delta T_{inlet}$, $2T_{s2}$ denotes an outlet thickness of the plastic deformation zone, $$T_{s2} = R + T_{gap} - \sqrt{R^2 - (R\sin\alpha_0)^2},$$

R denotes the roller flattening radius, $\alpha_0$ denotes the angle corresponding to the distance from the outlet position of the plastic deformation zone to the roller centerline, $2T_{inlet}$ denotes the inlet thickness of the slab, $2\Delta T_{inlet}$ denotes the compressed thickness of the inlet elastic compression zone, $2T_{gap}$ denotes the roller gap, and $2T_{outlet}$ denotes the outlet thickness of the slab.

In some embodiments, the method further includes, prior to determining the rolling force for the inlet elastic compression zone in operation 130, determining, based on the plurality of first rolling parameters, a first angle between the inlet position of the inlet elastic compression zone and the roller centerline, and a first contact angle between the inlet position of the inlet elastic compression zone and the plastic deformation zone.

In some embodiments, prior to determining the rolling force for the inlet elastic compression zone in operation 130, determining, based on the plurality of first rolling parameters, the first angle between the inlet position of the inlet elastic compression zone and the roller centerline, and the first contact angle between the inlet position of the plastic deformation zone and the roller centerline.

In some embodiments, the rolling force of the inlet elastic compression zone is determined based on the plurality of first rolling parameters, the first angle, and the first contact angle, using a second predetermined function model.

The first angle refers to the angle between the inlet position of the inlet elastic compression zone and the roller centerline.

The first contact angle refers to a contact angle between the inlet position of the plastic deformation zone and other positions. For example, the other positions include the roller centerline, etc.

In some embodiments, the server may, based on the roller flattening radius, the inlet thickness of the slab, and the roller gap, use the second predetermined function model to calculate the first angle $\theta_{inlet}$ corresponding to the distance between the inlet position of the inlet elastic compression and the roller centerline, and the first contact angle $\theta$ between the inlet position of the plastic deformation zone and the roller centerline.

In some embodiments, the second predetermined function model includes the following equations:

$$\theta_{inlet} = \arctan\frac{\sqrt{2R(T_{inlet}-T_{gap})-(T_{inlet}-T_{gap})^2}}{R} \tag{14}$$

$$\theta = \arctan\frac{\sqrt{2R(T_{s1}-T_{gap})-(T_{s1}-T_{gap})^2}}{R} \tag{15}$$

In the above equations, R denotes the roller flattening radius, $2T_{inlet}$ denotes the inlet thickness of the slab, $2T_{gap}$ denotes the roller gap, and $2T_{s1}$ denotes the inlet thickness of the plastic deformation zone.

In some embodiments, the rolling force $$P^e_{inlet}$$

of the inlet elastic deformation zone is determined using the second predetermined function model by considering an effect of a back tension on the inlet elastic compression zone.

In some embodiments, the second predetermined function model further includes the equation:

$$P^e_{inlet} = 2w\int_{l_{plastic}}^{l_{inlet}}\left(\frac{E_S}{1-v_s^2}\frac{T_{inlet-T_x}}{T_{inlet}}+\frac{v_sF_{back}}{4T_{inlet}w(1-v_s)}\right)dx = \frac{R(\sin\theta_{inlet}-\sin\theta)}{T_{inlet}(1-v_s)}\left[\frac{2E_sw(T_{inlet}-R-T_{gap})}{1+v_s}+\frac{v_sF_{back}}{2}\right]+\frac{E_swR^2[2\theta_{inlet}-2\theta+\sin(2\theta_{inlet})-\sin(2\theta)]}{2(1-v_s^2)T_{inlet}} \tag{16}$$

In the above equation, 2w denotes the width of the slab, $l_{inlet}$ denotes the distance from the inlet position of the inlet elastic compression zone to the roller centerline, $l_{plastic}$ denotes the distance from the inlet position of the plastic deformation zone to the roller centerline, $E_s$ denotes the elastic modulus of the slab, $v_s$ denotes the Poisson's ratio of the slab, $2T_{inlet}$ denotes the inlet thickness of the slab, 2T, denotes the thickness corresponding to any position of the deformation zone, $2T_{gap}$ denotes the roller gap, $F_{back}$ denotes the back tension of the slab, R denotes the roller flattening radius, $\theta_{inlet}$ denotes the first angle corresponding to distance from the inlet position of the elastic compression zone to the roller centerline, and $\theta$ denotes the first contact angle between the inlet position of the plastic deformation zone and the roller centerline.

In some embodiments of the present disclosure, the first angle between the inlet position of the elastic compression zone and the roller centerline and the first contact angle between the inlet position of the plastic deformation zone and the roller centerline are calculated, then the rolling force of the inlet elastic compression zone is determined using the second predetermined function model combined with the plurality of first rolling parameters. This approach enhances the accuracy of determining the rolling force of the inlet elastic compression zone, which further contributes to improving the accuracy and reliability of predicting the roller gap of the non-steady-state process, optimizes the setting of rolling process parameters, and helps increase rolling efficiency and product quality.

In some embodiments, the method further includes, prior to determining the rolling force of the outlet elastic recovery zone, determining a first recovery height corresponding to any position of the outlet elastic recovery zone based on a roller radius (also referred to as the roller flattening radius) and the inclination angle of the transition zone.

In some embodiments, based on the plurality of first rolling parameters and the first recovery height, a third predetermined function model is used to determine the rolling force of the outlet elastic recovery zone.

The first recovery height refers to an amount of vertical recovery of the material within the outlet elastic recovery zone during recovery after rolling.

In some embodiments of the present disclosure, the third predetermined function model is used to calculate the first recovery height $2T_{xoutlet}$ corresponding to any position of the outlet elastic recovery zone based on the roller flattening radius and the inclination angle of the transition zone.

As an example, the third predetermined function model includes the equation:

$$T_{xoutlet}=[x-(x_0-l_{outlet})]\tan\gamma+T_{outlet} \tag{17}$$

In the above equation, $x_0$ denotes the distance from the outlet position of the plastic deformation zone to the roller centerline, $x_0=R\cos\alpha_0$. $l_{outlet}$ denotes the projected contact arc length of the outlet elastic recovery zone in the rolling direction. $\gamma$ denotes the inclination angle of the transition zone. $2T_{outlet}$ denotes the outlet thickness of the slab.

In some embodiments of the present disclosure, the third predetermined function model is used to calculate the rolling force $$P^e_{outlet}$$

of the outlet elastic recovery zone by considering an effect of a front tension on the outlet elastic recovery zone.

As an example, the third predetermined function model includes the following equation:

$$\begin{aligned}P^e_{outlet} &= 2w\int_{x_0-l_{outlet}}^{x_0}\left(\frac{E_s}{1-v_s^2}\frac{T_{xoutlet}-T_x}{T_{xoutlet}}+\frac{F_{front}v_s}{4T_{outlet}w(1-v_s)}\right)dx = \\ &\frac{wRE_s}{(1-v_s^2)(T_{outlet}+T_{s2})}\{4[T_{outlet}-R-T_{gap}-(x_0-l_{outlet})\tan\gamma][ \\ &\sin\alpha_0-\sin(\alpha_0-\theta_{outlet})]+2R\tan\gamma[\sin^2\alpha_0-\sin^2(\alpha_0-\theta_{outlet})]+ \\ &R[2\theta_{outlet}+\sin 2\alpha_0-\sin(2\alpha_0-2\theta_{outlet})]\}+ \\ &\frac{Rv_sF_{front}}{2T_{outlet}(1-v_s)}[\sin\alpha_0-\sin(\alpha_0-\theta_{outlet})]\end{aligned} \tag{18}$$

In Equation (18), 2w denotes the width of the slab, $x_0$ denotes the distance from the outlet position of the plastic deformation zone to the roller centerline, $l_{outlet}$ denotes the projected contact arc length of the outlet elastic recovery zone in the rolling direction, $E_s$ denotes the elastic modulus of the slab, $v_s$ denotes the Poisson's ratio of the slab, $2T_{xoutlet}$ denotes the first recovery height corresponding to any position in the outlet elastic recovery zone, $2T_x$ denotes the thickness corresponding to any position in the deformation zone, $F_{front}$ denotes the front tension of the slab, $2T_{outlet}$ denotes the outlet thickness of the slab, R denotes the roller flattening radius, $\alpha_0$ denotes the angle corresponding to the distance from the outlet position of the plastic deformation zone to the roller centerline, $\gamma$ denotes the inclination angle of the transition zone, and $\theta_{outlet}$ denotes the angle corresponding to the outlet elastic recovery zone.

In some embodiments of the present disclosure, by calculating the first recovery height corresponding to any position of the outlet elastic recovery zone based on the roller flattening radius and the inclination angle of the transition zone before determining the rolling force of the outlet elastic recovery zone, and then determining the rolling force based on the plurality of first rolling parameters and the third predetermined function model, the prediction accuracy of the rolling force of the outlet elastic recovery zone can be improved, further optimizing the adjustment of the rolling process parameters, and ensuring the stability of subsequent rolling processes and the quality of the final product.

In some embodiments, in operation 140, the predetermined velocity field in the non-steady-state process deformation zone includes a velocity field in the non-steady-state process deformation zone of cold rolling thickness increase, established based on a predetermined boundary condition. The predetermined boundary condition includes at least a velocity boundary condition of the non-steady-state process deformation zone (also referred to as a velocity boundary condition of the non-steady-state process), a volume invariance condition, and a velocity in a vertical direction of the rollers. The predetermined boundary condition refers to a condition that is set in advance to define subsequent experiments. For example, the predetermined boundary condition includes the velocity boundary condition of the non-steady-state process deformation zone remains unchanged, the volume of the material in the non-steady-state process deformation zone remains unchanged, and the velocity of the rollers in the vertical direction. The predetermined boundary condition may be set by a skilled professional or by system default.

The velocity boundary condition of the non-steady-state process deformation zone refers to a variation of velocity with position at a boundary of a region where the non-steady-state process deformation zone is located. The velocity boundary condition is a condition to verify whether a velocity field is correct. A verified velocity field represents a functional relationship that governs the velocity of the material.

The volume invariance condition refers to that the volume of the material in the non-steady-state process deformation zone remains constant during plastic deformation, i.e., there is no addition or reduction of material. That is to say, the volume of the material entering the non-steady-state process deformation zone is equal to the volume of the material leaving the deformation zone (without considering material losses).

The velocity in the vertical direction of the rollers (also referred to as the vertical velocity of the rollers) is a vertical velocity of the rollers in the non-steady-state process.

In some embodiments, the server determines an inlet unit flow rate of the slab per second in a variety of ways. For example, the server may measure the inlet unit flow rate of the slab using a flow meter (e.g. an electromagnetic flow meter, a vortex flow meter, etc.).

In some embodiments, determining the plastic deformation zone through function calculations using the predetermined energy technique includes: when the velocity boundary condition and the volume of the material in the non-steady-state process deformation zone remain unchanged, determining that inlet unit flow rate of the slab per second based on a velocity of the rollers (also referred to as a rotation velocity of the rollers) and a neutral angle using a fourth predetermined function model.

The inlet unit flow rate of the slab per second refers to the volume flow rate of the slab passing through an inlet of a rolling mill per unit of time, usually measured in cubic meters per second ($m^3/s$).

In some embodiments, the inlet unit flow rate U of the slab per second may be determined based on the rotation velocity of the rollers and the neutral angle based on characteristics of the non-steady-state process during cold rolling thickness increase and the condition of constant volume of the material.

As an example, the fourth predetermined function model includes the following equation:

$$U=wv_0T_{s1}=2\pi nR_0w\cos\alpha_n(T_{s1}+R\cos\theta-R\cos\alpha_n)+VRw(\theta-\alpha_n) \tag{19}$$

In the above equation, U denotes the inlet unit flow rate of the slab per second, 2w denotes the width of the slab, $v_0$ denotes an inlet velocity of the slab, n denotes the rotation velocity of the rollers, $R_0$ denotes the original roller flattening radius, R denotes the roller flattening radius, $2T_{s1}$ denotes the inlet thickness of the plastic deformation zone, θ denotes the first contact angle between the inlet position of the plastic deformation zone and the roller centerline, and an is the neutral angle, which is a constant that varies with the rolling process parameters, and $0\leq\alpha_n\leq 0$.

In some embodiments of the present disclosure, an average compression rate $\bar{\varepsilon}$ of the slab may be determined based on the characteristics of the non-steady-state process during cold rolling thickness increase. The average compression rate is then substituted into the deformation resistance model to obtain an average deformation resistance $\bar{\delta}_s$.

As an example, the fourth predetermined function model includes the following equations:

$$\bar{\varepsilon}=\frac{T-T_{inlet}}{3T}+\frac{2(T-T_{outlet})}{3T} \tag{20}$$

$$\bar{\delta}_s=A_0\left[\frac{T-T_{inlet}}{3T}+\frac{2(T-T_{outlet})}{3T}\right]^{A_1}-0.125\left(\frac{F_{back}}{T_{inlet}w}+\frac{F_{front}}{T_{outlet}w}\right) \tag{21}$$

In the above equations, 2T denotes the original thickness of the slab, $2T_{inlet}$ denotes the inlet thickness of the slab, $2T_{outlet}$ denotes the outlet thickness of the slab, 2w denotes the width of the slab, $F_{front}$ denotes the front tension of the slab, $F_{back}$ denotes the back tension of the slab, $A_0$ and $A_1$ are nonlinear regressive coefficients, which are related to the material's properties.

In some embodiments of the present disclosure, by using the predetermined energy technique for function calculation, while keeping the velocity boundary condition and the volume of the material in the non-steady-state process deformation zone constant, the inlet unit flow rate of the slab per second is determined based on the rotation velocity of the rollers and the neutral angle using the fourth predetermined function model, thus improving the accuracy of the prediction of the inlet flow rate of the slab, which is conducive to further improving the accuracy of the determined roller gap.

In some embodiments of the present disclosure, by establishing the velocity field in the non-steady-state process deformation zone based on the predetermined boundary condition, including the velocity boundary condition of the non-steady-state process deformation zone remaining unchanged the volume of the material in the non-steady-state process deformation zone remaining unchanged, and the vertical velocity of the rollers, a more accurate simulation and prediction of the velocity distribution in the deformation zone during thickness increase in the cold rolling process can be achieved. This helps further improve the accuracy of subsequent roller gap predictions.

In some embodiments, using the predetermined energy technique for function calculation includes: determining, based on the plurality of first rolling parameters, the velocity field in the non-steady-state process deformation zone, the inlet unit flow rate of the slab per second, and the average deformation resistance, regional powers in the non-steady-state process deformation zone using a fifth predetermined function model, wherein the regional powers in the non-steady-state process deformation zone includes an internal deformation power of the slab, a shear power of the rollers on the slab, a friction power between the slab and the rollers, and a tension power of the slab.

The average deformation resistance refers to the deformation resistance of a material as it continuously passes through the deformation zone under rolling force. Since the deformation resistance at different cross-sections varies and is difficult to solve by integration, a simplified algorithm is used to obtain the deformation resistance.

The internal deformation power refers to a power generated by the plastic deformation occurring within the deformation zone of the slab during the rolling process.

The shear power refers to a power generated by the shear action of the rollers on the inlet and outlet positions of the deformation zone of the slab during the rolling process.

The friction power refers to a power generated by a friction action on a contact surface between the slab and the rollers.

The tension power refers to a power generate when the slab is subjected to the front and back tensions during the rolling process.

In some embodiments, the regional powers in the non-steady-state process during cold rolling thickness increase may be determined based on the velocity field, the inlet unit flow rate of the slab per second, and the average deformation resistance, thereby determining a total power functional $W_{total}$. In some embodiments, the server also determines the total power functional by other feasible functions and/or models, which are not limited herein.

As an example, the fifth predetermined function model includes the following equation:

$$W_{internal}=\frac{4\pi}{3\sqrt{3}}\bar{\delta}_s U\left[\frac{1}{\lambda}\frac{T_{s2}}{T_{s1}}\sin h\left(\lambda\frac{T_{s2}-T_{s1}}{T_{s1}}\right)-\frac{2}{\lambda^2}\cos h\left(\lambda\frac{T_{s2}-T_{s1}}{T_{s1}}\right)-1+\frac{T_{s2}}{Ts1}+\frac{2}{\lambda^2}\right]+\frac{8\pi w^2}{3\sqrt{3}}\bar{\delta}_s VR\left[(\theta-\overline{\psi_m})\ln\left(\frac{T_{s1}}{T_{s2}}\right)+\theta-\alpha_0\right] \tag{22}$$

The internal deformation power $W_{internal}$ of the slab is calculated by Equation (22).

As an example, the fifth predetermined function model includes the following equation:

$$W_{shear} = \frac{2\bar{\delta}_s}{\sqrt{3}} U \tan\theta - \frac{2\bar{\delta}_s w T_{s1} VR \tan\theta}{\sqrt{3}\, l_{plastic}} + \frac{2\bar{\delta}_s}{\sqrt{3}} w T_{s2} \tan\alpha_0 = \sqrt{\left\{\frac{U}{wT_{s1}}\left[1+\frac{1}{\lambda}\sinh\left(\lambda\frac{T_{s1}-T_{s2}}{T_{s1}}\right)\right]-\left[\frac{VR(\theta-\alpha_0)}{T_{s2}}+\frac{VR}{x_0}\right]\right\}^2+\left(\frac{U}{T_{s1}}\right)^2\left\{\frac{1}{T_{s1}}\cosh\left(\lambda\frac{T_{s1}-T_{s2}}{T_{s1}}\right)-\frac{1}{T_{s2}}\left[1+\frac{1}{\lambda}\sinh\left(\lambda\frac{T_{s1}-T_{s2}}{T_{s1}}\right)\right]\right\}^2} \tag{23}$$

The shear power $W_{shear}$ of the rollers on the slab is calculated by Equation (23).

As an example, the fifth predetermined function model includes the following equation:

$$W_{friction} = \frac{8\bar{\delta}_s}{\sqrt{3}} wf\Big\{2\pi n R_0 R(\theta - 2\alpha_{nR} + \alpha_0) + VR(\cos\theta - 2\cos\alpha_n + \cos\alpha_0) + \frac{UR}{wT_{s1}}\ln\left(\frac{\tan^2\left(\frac{\alpha_n}{2}+\frac{\pi}{4}\right)}{\left(\tan\left(\frac{\alpha_0}{2}+\frac{\pi}{4}\right)\tan\left(\frac{\theta}{2}+\frac{\pi}{4}\right)\right)}\right) + \frac{RQ_f}{\lambda}\frac{2U}{wT_{s1}} + \left[\operatorname{atanh}\left(\tan\frac{\alpha_n}{2}\right) - \operatorname{atanh}\left(\tan\frac{\alpha_0}{2}\right)\right] - \frac{RQ_b}{\lambda}\frac{2U}{wT_{s1}}\left[\operatorname{atanh}\left(\tan\frac{\theta}{2}\right) - \operatorname{atanh}\left(\tan\frac{\alpha_n}{2}\right)\right] + VR\ln\frac{\cos^2\alpha_n}{\cos\theta\cos\alpha_0} + \frac{2VR(\bar{\psi}_m - \theta)}{M\sqrt{M^2-1}} \times \left\{2\arctan\left[\sqrt{\frac{M+1}{M-1}}\tan\left(\frac{\alpha_n}{2}\right)\right] - \arctan\left[\sqrt{\frac{M+1}{M-1}}\tan\left(\frac{\alpha_0}{2}\right)\right] - \arctan\left[\sqrt{\frac{M+1}{M-1}}\tan\left(\frac{\theta}{2}\right)\right] + \frac{\sqrt{M^2-1}}{2}\ln\frac{\tan^2\left(\frac{\pi}{4}+\frac{\alpha_n}{2}\right)}{\tan\left(\frac{\pi}{4}+\frac{\alpha_0}{2}\right)\tan\left(\frac{\pi}{4}+\frac{\theta}{2}\right)}\right\}\Big\} \tag{24}$$

The friction power $W_{friction}$ between the slab and the rollers is calculated by Equation (24).

As an example, the fifth predetermined function model includes the following equation:

$$W_{tension} = \frac{U}{w}\left(\frac{F_{back}}{T_{inlet}} - \frac{F_{front}}{T_{outlet}}\right) + \frac{VRF_{front}(\theta-\alpha_0)}{T_{outlet}} \tag{25}$$

The tension power $W_{tension}$ of the slab is calculated by Equation (25).

In Equations (22) to (25), $\bar{\delta}_s$ denotes the average deformation resistance of the slab, U denotes the inlet unit flow rate of the slab per second, λ denotes an undetermined parameter, which may be obtained based on a relationship between an inlet flow rate and an outlet flow rate, $2T_{s1}$ denotes the inlet thickness of the plastic deformation zone, $2T_{s2}$ denotes the outlet thickness of the plastic deformation zone, 2w denotes the width of the slab, V is the vertical velocity of the rollers, R denotes the roller flattening radius, θ denotes the first contact angle between the inlet position of the plastic deformation zone and the roller centerline, $\bar{\psi}_m$ is an average value of contact angles of the deformation zone, denotes the angle $$\bar{\psi}_m = \frac{\int_{\alpha_0}^{\theta} \alpha R\cos\alpha\, d\alpha}{R\sin\theta - R\sin\alpha_0},$$

$\alpha_0$ denotes the angle corresponding to the distance from the outlet position of the plastic deformation zone to the roller centerline, $l_{plastic}$ denotes the distance from inlet position of the plastic deformation zone to the roller centerline, $x_0$ denotes the distance from the outlet position of the plastic deformation zone to the roller centerline, f denotes a coefficient of friction, n denotes the rotation velocity of the rollers, $\alpha_n$ denotes the neutral angle, M denotes a parameter related with the roller flattening radius and the inlet thickness of the plastic deformation zone, $$M = \frac{T_{s1}}{R} + \cos\theta,$$

$Q_f$ denotes a parameter related to a thickness of a front slip zone, $$Q_f = \sinh\left[\lambda\left(1 - \frac{T_{\alpha_n} + 2T_{s2}}{3T_{s1}}\right)\right],$$

$Q_b$ denotes a parameter related to a thickness of a rear slip zone $$Q_b = \sinh\left[\lambda\left(1 - \frac{T_{s1} + T_{\alpha_n}}{3T_{s1}}\right)\right],$$

$F_{front}$ denotes the front tension of the slab, $F_{back}$ denotes the back tension of the slab.

The front slip zone refers to a region where the slab begins to enter the roller gap at an entrance side of the rollers. The rear slip zone refers to a region where the slab just leaves the roller gap at an exit side of the rollers.

Further, the total power $W_{total}$ in the non-steady-state process deformation zone is obtained by summing the regional powers in the non-steady-state process deformation zone using the following equation:

$$W_{total} = W_{internal} + W_{shear} + W_{friction} + W_{tension} \tag{26}$$

In the above equation, $W_{internal}$ denotes the internal deformation power of the slab, $W_{friction}$ denotes the friction power between the slab and the rollers, $W_{shear}$ denotes the shear power of the rollers on the slab, and $W_{tension}$ denotes the tension power of the slab.

Further, differential is performed on the total power in the non-steady-state process deformation zone using the following equation to obtain a value corresponding to the neutral angle:

$$\frac{dW_{total}}{d\alpha_n} = 0 \tag{27}$$

In the above equation, $W_{total}$ denotes the total power in the non-steady-state process deformation zone, and $\alpha_n$ denotes the neutral angle.

Based on the value corresponding to the neutral angle, values corresponding to the regional powers in the non-steady-state process deformation zone are obtained using Equations (22) to (24) in the fifth predetermined function model. A minimum value of the total power functional is obtained in this operation by differentiating the total power with respect to the neutral angle.

In some embodiments, the rolling force $P_{plastic}$ of the plastic deformation zone is determined based on a relationship between the total power functional and the rolling force of the plastic deformation zone.

As an example, the fifth predetermined function model includes Equation (28):

$$P_{plastic} = \frac{(W_{internal} + W_{friction} + W_{shear})}{1.6\pi n\sqrt{2R(T_{s1} - T_{gap}) - (T_{s1} - T_{gap})^2}} \tag{28}$$

The rolling force $P_{plastic}$ of the plastic deformation zone is calculated by Equation (28). $W_{internal}$ denotes the internal deformation power of the slab, $W_{friction}$ denotes the friction power between the slab and the rollers, $W_{shear}$ denotes the shear power of the rollers on the slab, n denotes the rotation velocity of the rollers, $2T_{s1}$ denotes the inlet thickness of the plastic deformation zone, and $2T_{gap}$ denotes the roller gap.

In some embodiments of the present disclosure, by performing function calculation using the predetermined energy technique based on the plurality of first rolling parameters, the velocity field in the non-steady-state process deformation zone, the inlet unit flow rate of the slab per second, and the average deformation resistance, the regional powers in the non-steady-state process deformation zone, including the internal deformation power of the slab, the shear power of the rolls on the slab, the friction power between the slab and the rollers, and the tension power of the slab, so as to realize the accurate calculation of the total power in the non-steady-state process deformation zone. The value corresponding to the neutral angle is obtained by differentiating the total power, and the values of the regional powers in the non-steady-state process deformation zone are determined based on the value of the neutral angle, which improves the accuracy of the prediction of the roller gap of the rollers, optimizes the rolling process, and enhances production efficiency and product quality.

In some embodiments, in operation 150, determining the first total rolling force of the non-steady-state process deformation zone that meets the predetermined convergence condition includes the following operations:

A total rolling force of the non-steady-state process deformation zone is obtained by summing the rolling force of the inlet elastic compression zone, the rolling force of the outlet elastic recovery zone, and the rolling force of the plastic deformation zone. A roller flattening radius is determined based on the total rolling force of the non-steady-state process deformation zone and the plurality of first rolling parameters, using a sixth predetermined function model. Whether a logical relationship between a roller flattening radius in an $i^{th}$ iteration and a roller flattening radius in a $(i-1)^{th}$ iteration satisfies the predetermined convergence condition is determined.

If the logical relationship between the roller flattening radius in the $i^{th}$ iteration and the roller flattening radius in the $(i-1)^{th}$ iteration satisfies the predetermined convergence condition, the total rolling force is determined as the first total rolling force of the non-steady-state process deformation zone.

If the logical relationship between the roller flattening radius in the $i^{th}$ iteration and the roller flattening radius in the $(i-1)^{th}$ iteration does not satisfy the predetermined convergence condition, then return to operation 110, and function calculations are performed according to operations 110-150 of the method disclosed in the present disclosure.

In some embodiments, the rolling forces $$P^e_{inlet},$$

$$P^e_{outlet},$$

and $P_{plastic}$ are summed to obtain the total rolling force $P_{total}$, and according to a coupling relationship between the rolling force and the roller flattening radius, the rolling force that meets the predetermined convergence condition is determined.

As an example, the total rolling force of the non-steady-state process deformation zone may be obtained using Equation (29):

$$P_{total} = P^e_{inlet} + P_{plastic} + P^e_{outlet} \tag{29}$$

As an example, the sixth predetermined function model includes Equation (30):

$$R = R_0\left[1 + \frac{1.7\times10^{-12}}{\pi w}\frac{P_{total}}{\left(\sqrt{T_{inlet} - T_{gap} + \Delta T_t} - \left(\sqrt{T_{inlet} - T_{gap}}\right)^2\right)}\right] \tag{30}$$

$$\Delta T_t = \frac{v_s(1 + v_s)(F_{back} + F_{front})}{4wE_s} \tag{31}$$

The roller flattening radius may be determined based on the coupling relationship between the rolling force and the roller flattening radius expressed in Equation (30) and Equation (31).

The predetermined convergence condition may be expressed by Equation (32):

$$\frac{|R_i - R_{i-1}|}{R_i} \le 0.01 \tag{32}$$

In Equations (30) to (32), $$P^e_{inlet}$$

denotes the rolling force of the inlet elastic compression zone, $P_{plastic}$ denotes the rolling force of the plastic deformation zone, $$P^{e}_{outlet}$$

denotes the rolling force of the outlet elastic recovery zone, R denotes the roller flattening radius, $R_0$ denotes the original roller flattening radius, 2w denotes the width of the slab, $2T_{inlet}$ denotes the inlet thickness of the slab, $2T_{gap}$ denotes the roller gap, $2T_{outlet}$ denotes the outlet thickness of the slab, $\Delta T_t$ denotes an effect of the front and back tensions on the roller flattening radius, $E_s$ denotes the elastic modulus of the slab, $v_s$ denotes the Poisson's ratio of the slab, $F_{front}$ denotes the front tension of the slab, $F_{back}$ denotes the back tension of the slab, $R_i$ denotes the roller flattening radius in the $i^{th}$ iteration, $R_{i-1}$ denotes the roller flattening radius in the $(i-1)^{th}$ iteration.

For example, when i=1, $R_i$ is a roller flattening radius in a first iteration, and $R_{i-1}$ is the original radius of the rollers. When i=5, $R_i$ is a roller flattening radius in a fifth iteration, and $R_{i-1}$ is a roller flattening radius in a fourth iteration.

It should be noted that Equation (32) expresses the meaning that if the logical relationship between the roller flattening radius in the $i^{th}$ iteration and the roller flattening radius in the $(i-1)^{th}$ iteration is less than or equal to 0.01, the total rolling force $P_{total}$ is determined as the first total rolling force $$P'_{total}$$

in the non-steady-state process deformation zone.

If the logical relationship between the roller flattening radius in the $i^{th}$ iteration and the roller flattening radius in the $(i-1)^{th}$ iteration is greater than 0.01, then return to operation 110, and function calculations are performed according to operations 110-150 of the method disclosed in the present disclosure until the logical relationship between the roller flattening radius in the $i^{th}$ iteration and the roller flattening radius in the $(i-1)^{th}$ iteration is less than or equal to 0.01. Afterward, operation 160 is performed.

In some embodiments, in operation 160, determining the roller gap based on the plurality of first rolling parameters and the first total rolling force through function calculations using the first predetermined function model includes:

Based on the first total rolling force $$P'_{total}$$

and a stiffness K of a rolling mill, a roller gap $S_{gap}$ taking into account the stiffness of the rolling mill is determined using Equation (33):

$$S_{gap} = 2T_{gap} - \frac{P'_{total}}{K} \tag{33}$$

In Equation (33), $S_{gap}$ denotes the roller gap taking into account the stiffness of the rolling mill, $2T_{gap}$ denotes the roller gap, $$P'_{total}$$

denotes the first total rolling force, and K denotes the stiffness of the rolling mill.

In some embodiments of the present disclosure, by setting the predetermined convergence condition that includes a variation of the roller flattening radius, it is possible to ensure that an iterative calculation for the prediction of the roller gap in the non-steady-state process converges quickly and stably to an accurate solution, thus improving the accuracy of the roller gap prediction.

Figure 3:
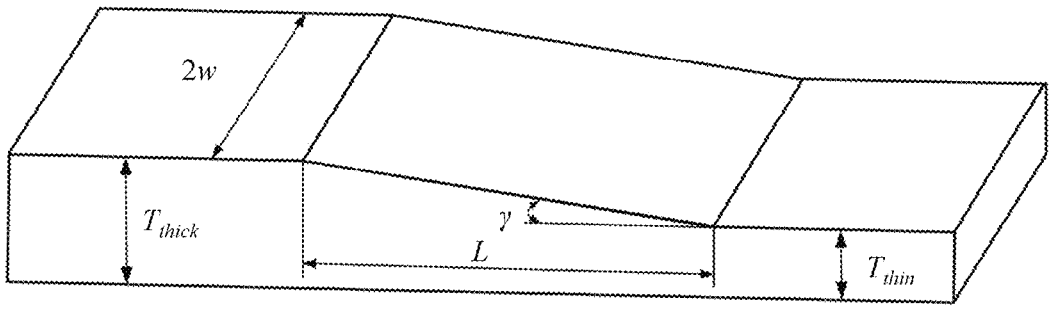
FIG. 3 is a schematic diagram of half of a structure of a product in a non-steady-state process of cold rolling thickness increase, based on a method for predicting a roller gap in the non-steady-state process, according to some embodiments of the present disclosure.
Figure 4:
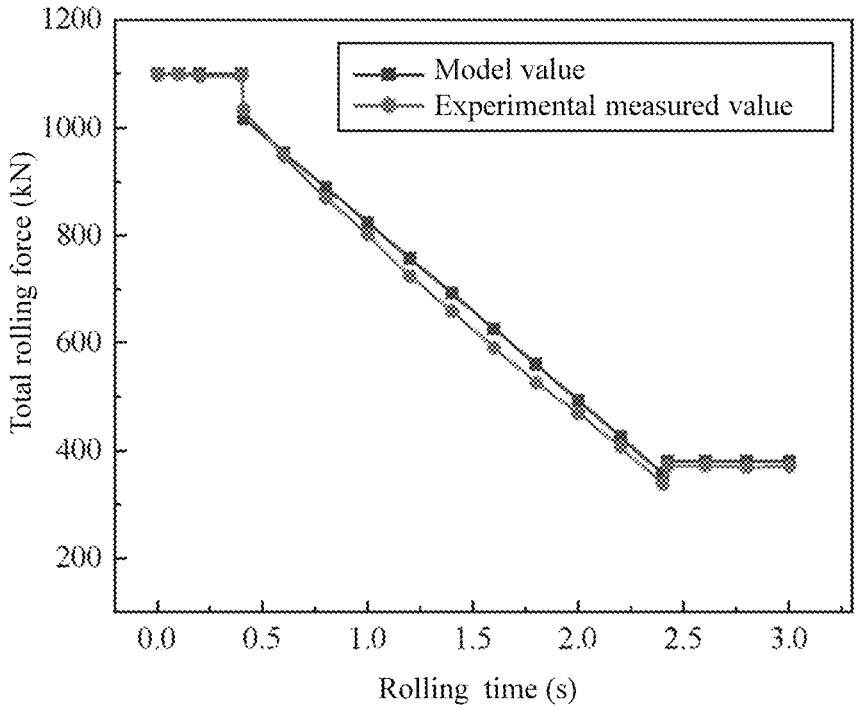
FIG. 4 is a schematic diagram comparing measured values of a total rolling force and calculated values of the total rolling force using a method for predicting a roller gap in a non-steady-state process according to some embodiments of the present disclosure.
Figure 5:
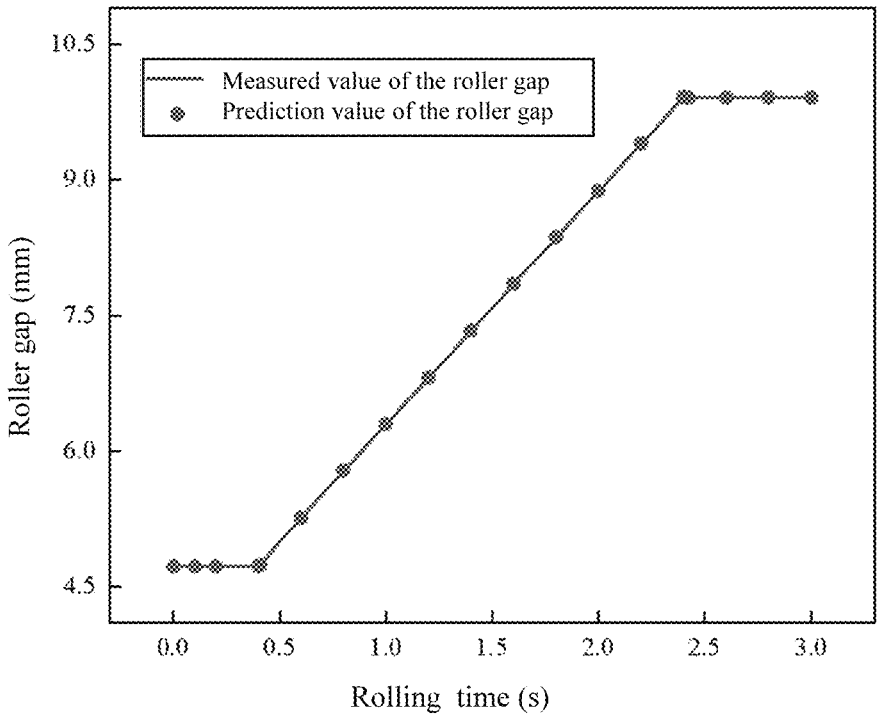
FIG. 5 is a schematic diagram comparing measured values of a roller gap and predicted values of the roller gap using a method for predicting a roller gap in a non-steady-state process according to some embodiments of the present disclosure.

In some embodiments, FIG. 2*a* to FIG. 5 are illustrated as specific examples. FIG. 3 is a schematic diagram of half of a structure of a product in a non-steady-state process of cold rolling thickness increase, based on a method for predicting a roller gap in the non-steady-state process, according to some embodiments of the present disclosure. FIG. 4 is a schematic diagram comparing measured values of a total rolling force and calculated values of the total rolling force using a method for predicting a roller gap in a non-steady-state process according to some embodiments of the present disclosure. FIG. 5 is a schematic diagram comparing measured values of a roller gap and predicted values of the roller gap using a method for predicting a roller gap in a non-steady-state process according to some embodiments of the present disclosure. FIG. 2*b* is an enlarged schematic diagram of a structure corresponding to position A in FIG. 2*a* according to some embodiments of the present disclosure.

Referring to FIG. 2*a*, FIG. 2*b*, and FIG. 3, in operation 110 described above, a plurality of first rolling parameters are obtained. The first rolling parameters may include process parameters for the rolling process of the slab, such as: the original thickness 2T of the slab, 2T=12 mm, the inlet thickness $2T_{inlet}$ of the slab, $2T_{inlet}$=12 mm, the width 2w of the slab, 2w=100 mm, the thickness $2T_{thick}$ of the product thick zone, $2T_{thick}$=10 mm, the thickness $2T_{thin}$ of product thin zone, $2T_{thin}$=5 mm, the length L of the product transition zone, L=300 mm, the front tension $F_{front}$ and the back tension $F_{back}$ of the slap during the rolling process, $F_{front}$=30 kN, $F_{back}$=30 kN, the rotation velocity n of the rollers, n=0.16 r/s, the vertical velocity V of the rollers, V=1.25 mm/s, the original roller fattening radius $R_0$, $R_0$=150 mm, and the coefficient f of friction between the rollers and the slab, f=0.3.

In some embodiments, based on the first rolling parameters, time $t_{transition}$ of the transition zone in the non-steady-state process of cold rolling thickness increase, the inclination angle $\gamma$ of the transition zone, and the outlet thickness $2T_{outlet}$ of the outlet elastic recovery zone at any time t are determined using the following equations:

$$t_{transition} = \frac{2T_{thick} - 2T_{thin}}{2V} = \frac{10-5}{2\times 1.25} = 2s \tag{34}$$

$$\gamma = \arctan\frac{T_{thick} - T_{thin}}{L} = \arctan\frac{5-2.5}{300} = 0.477° \tag{35}$$

$$T_{outlet} = (2.5 + 1.25t)\times 10^{-3}m \tag{36}$$

In Equations (34) to (36), $2T_{thick}$ denotes the thickness of the product thick zone, $2T_{thin}$ denotes the thickness of the product thin zone, V denotes the vertical velocity of the rollers, and L denotes the length of the product transition zone.

In some embodiments, a stress-strain curve of the material is obtained based on an electronic universal material testing machine, and the curve is fitted to obtain a deformation resistance model for the material. The curve is fitted using Equation (37).

$$\delta_s = A_0\varepsilon^{A_1} = 277\varepsilon^{0.1563} \tag{37}$$

In Equation (37), $\delta_s$ denotes the deformation resistance of the material, and $\varepsilon$ denotes the engineering strain of the material.

In some embodiments, the deformation zone is divided into the inlet elastic compression zone I, the plastic deformation zone II, and the outlet elastic recovery zone III based on the characteristics of the rolling deformation zone, and the compressed thickness $2\Delta T_{inlet}$ of the inlet elastic compression zone and the recovered thickness $2\Delta T_{outlet}$ of the outlet elastic recovery zone are determined using the following equations:

$$\Delta T_{inlet} = \frac{T_{inlet}}{E_s}\left[(1-v_s^2)\delta_{s0} - \frac{(1+v_s)v_sF_{back}}{4T_{inlet}w}\right] = \frac{6\times10^{-3}}{7\times10^{10}}\left[(1-0.33^2)\times70\times10^6 - \frac{(1+0.33)\times0.33\times30\times10^3}{4\times6\times50\times10^{-6}}\right] = 4.41\times10^{-6}m \tag{38}$$

$$\Delta T_{outlet} = \frac{T_{outlet}}{E_s}\left[(1-v_s^2)A_0\left(\frac{T-T_{outlet}}{T}\right)^{A_1} - \frac{(1+v_s)v_sF_{front}}{4T_{outleft}w}\right] = \left[21.17\times\left(\frac{6-T_{outlet}}{6}\right)^{0.1563} - \frac{5.64}{T_{outlet}}\right]\times10^{-6}m \tag{39}$$

In Equations (37) and (38), $E_s$ denotes the elastic modulus of the slab, $v_s$ denotes the Poisson's ratio of the slab, $2T_{inlet}$ denotes the inlet thickness of the slab, $\delta_{s0}$ denotes the yield strength of the material, 2T denotes the original thickness of the slab, $2T_{outlet}$ denotes the outlet thickness of the slab, 2w denotes the width of the slab, $F_{front}$ denotes the front tension of the slab, $F_{back}$ denotes the back tension of the slab, and $\Delta T_{outlet}$ may be calculated when the time t is determined.

In some embodiments, the angle do corresponding to the distance from the outlet position of the plastic deformation zone to the roller centerline, the angle $\theta_{outlet}$ corresponding to the outlet elastic recovery zone, the roller gap $2T_{gap}$, and the thickness 2T, corresponding to any position in the deformation zone may be determined based on the roller flattening radius, the outlet thickness of the slab, and the first rolling parameters, using the following equations:

$$\theta_{outlet} = \arcsin\frac{\sqrt{2R\Delta T_{outlet}\cos\alpha_0}}{R} = \frac{\sqrt{2R\Delta T_{outlet}\cos0.4775^\circ}}{R} \tag{40}$$

$$T_{gap} = T_{outlet} + R\cos(\alpha_0 - \theta_{outlet}) - R = (2.5+1.25t) + R\cos(0.4775^\circ - \theta_{outlet}) - R \tag{41}$$

$$T_x = R + T_{gap} - \sqrt{R^2 - x^2} \tag{42}$$

$$\alpha_0 = \arctan\left(\frac{1}{L}\left\{T_{thick} - \frac{T_{inlet}}{E_s}\left[(1-v_s^2)\delta_{s0} - \frac{(1+v_s)v_sF_{back}}{4T_{inlet}w}\right]\right\} - \frac{1}{L}\left\{T_{thin} - \frac{T_{thin}}{E_s}\left[(1-v_s^2)A_0\left(\frac{T-T_{thin}}{T}\right)^{A_1} - \frac{(1+v_s)v_sF_{front}}{4T_{outlet}w}\right]\right\}\right) = \tag{43}$$

$$\arctan\left(\frac{1}{300\times10^{-3}}\left\{5\times10^{-3} - \frac{6\times10^{-3}}{7\times10^{10}}\left[(1-0.33^2)\times70\times10^6 - \frac{(1+0.33)\times0.33\times30\times10^3}{4\times6\times50\times10^6}\right]\right\} - \frac{1}{300\times10^{-3}}\left\{2.5\times10^{-3} - \frac{2.5\times10^{-3}}{7\times10^{10}}\left[(1-0.33^2)\times277\times\left(\frac{6-2.5}{6}\right)^{0.1563}\times10^6 - \frac{(1+0.33)\times0.33\times30\times10^3}{4\times2.5\times50\times10^6}\right]\right\}\right) = 0.4775^\circ$$

In Equations (40) to (43), $2T_{gap}$ denotes the outlet thickness of the slab, R denotes the roller flattening radius, $2T_{gap}$ denotes the roller gap, L denotes the length of the product transition zone, $2T_{thick}$ denotes the thickness of the product thick zone, $\delta_{s0}$ denotes the yield strength of the material, $E_s$ denotes the elastic modulus of the slab, $v_s$ denotes the Poisson's ratio of the slab, $A_0$ and $A_1$ are nonlinear regression coefficients, which are related to the properties of the material, $2T_{inlet}$ denotes the inlet thickness of the slab, 2T denotes the original thickness of the slab, 2w denotes the width of the slab, $F_{front}$ denotes the front tension of the slab, $F_{back}$ denotes the back tension of the slab, $2T_{thin}$ denotes the thickness of the product thin zone, and $2\Delta T_{outlet}$ denotes the recovered thickness of the outlet elastic recovery zone. When the time t is determined, $\theta_{outlet}$, $T_{gap}$, and $T_x$ may be determined.

In some embodiments, based on the first rolling parameters, the distance $l_{inlet}$ from the inlet position of the inlet elastic compression zone I to the roller centerline, the distance $l_{plastic}$ from the inlet position of the plastic deformation zone II to the roller centerline, and the projected contact arc length $l_{outlet}$ of the outlet elastic recovery zone III in the rolling direction are determined using the following equations:

$$l_{inlet} = \sqrt{2R(T_{inlet} - T_{gap}) - (T_{inlet} - T_{gap})^2} = \sqrt{2R(6\times10^{-3} - T_{gap}) - (6\times10^{-3} - T_{gap})^2} \tag{44}$$

$$l_{plastic} = \sqrt{2R(T_{s1} - T_{gap}) - (T_{s1} - T_{gap})^2} = \sqrt{2R(T_{inlet} - \Delta T_{inlet} - T_{gap}) - (T_{inlet} - \Delta T_{inlet} - T_{gap})^2} = \sqrt{2R(5.995\times10^{-3} - T_{gap}) - (5.995\times10^{-3} - T_{gap})^2}\,m \tag{45}$$

$$l_{ouftet} = \sqrt{2R(T_{s2} - T_{gap}) - (T_{s2} - T_{gap})^2} - \sqrt{2R(T_{outlet} - T_{gap}) - (T_{outlet} - T_{gap})^2} \tag{46}$$

In Equations (44) to (46), R denotes the roller flattening radius, $2T_{inlet}$ denotes the inlet thickness of the slab, $2T_{gap}$ denotes the roller gap, $2T_{s1}$ denotes the inlet thickness of the plastic deformation zone, $T_{s1}=T_{inlet}-\Delta T_{inlet}$, $2T_{s2}$ denotes the outlet thickness of the plastic deformation zone, $T_{s2}=R+T_{gap}-\sqrt{R^2-(R\sin\alpha_0)^2}$, $\alpha_0$ denotes the angle corresponding to the distance from the outlet position of the plastic deformation zone to the roller centerline, $2\Delta T_{inlet}$ denotes the compressed thickness of the inlet elastic compression zone, and $2T_{outlet}$ denotes the outlet thickness of the slab. When the time t is determined, $l_{inlet}$, $l_{plastic}$, and $l_{outlet}$ may be determined.

In operation 130, the rolling force $$P_{inlet}^{e}$$

of the inlet elastic compression zone and the rolling force $$P^e_{outlet}$$

of the outlet elastic recovery zone may be calculated based on a predetermined elastic mechanics calculation model.

In some embodiments, as shown in FIG. 2*a*, in the schematic diagram of half of the structure of the deformation zone in the non-steady-state process of cold rolling thickness increase, a Cartesian coordinate system is established. The mid-point of the line connecting the centers of the rollers is taken as the origin of the coordinate system, the rolling direction is taken as the x-axis of the coordinate system, a direction of the thickness of the slab is taken as the y-axis of the coordinate system, and a direction of the width of the slab is taken as the z-axis of the coordinate system.

In some embodiments, based on the roller flattening radius, the thickness of the slab, and the roller gap, the first angle $\theta_{inlet}$ corresponding to the distance from the inlet position of the inlet elastic compression zone to the roller centerline, and the first contact angle θ between the inlet position of the plastic deformation zone and the roller centerline are determined using the following equations:

$$\theta_{inlet} = \arctan\frac{\sqrt{2R(T_{inlet} - T_{gap}) - (T_{inlet} - T_{gap})^2}}{R} = \frac{\sqrt{2R(6\times10^{-3} - T_{gap}) - (6\times10^{-3} - T_{gap})^2}}{R} \tag{47}$$

$$\theta = \arctan\frac{\sqrt{2R(T_{s1} - T_{gap}) - (T_{s1} - T_{gap})^2}}{R} = \arctan\frac{\sqrt{2R(5.995\times10^{-3} - T_{gap}) - (5.995\times10^{-3} - T_{gap})^2}}{R} \tag{48}$$

In Equations (47) and (48), R denotes the roller flattening radius, $2T_{inlet}$ denotes the inlet thickness of the slab, $2T_{gap}$ denotes the roller gap, and $2T_{s1}$ denotes the inlet thickness of the plastic deformation zone. When the time t is determined, $\theta_{inlet}$ and θ may be determined.

In some embodiments, considering the effect of the back tension of the slab on the inlet elastic compression zone, the rolling force $$P^e_{inlet}$$

of the inlet elastic compression zone is determined using Equation (49):

$$P^e_{inlet} = \frac{R(\sin\theta_{inlet} - \sin\theta)}{T_{inlet}(1-\nu_s)}\left[\frac{2E_S w(T_{inlet} - R - T_{gap})}{1+\nu_s} + \frac{\nu_s F_{back}}{2}\right] + \frac{E_s w R^2[2\theta_{inlet} - 2\theta + \sin(2\theta_{inlet}) - \sin(2\theta)]}{2(1-\nu_s^2)T_{inlet}} = \frac{R(\sin\theta_{inlet} - \sin\theta)}{4.02\times10^{-3}}\left[5.26\times10^9\times(6\times10^{-3} - R - T_{gap}) + 4.95\times10^3\right] + 3.27\times10^{11}R^2[2\theta_{inlet} - 2\theta + \sin(2\theta_{inlet}) - \sin(2\theta)]N \tag{49}$$

In Equation (49), 2w denotes the width of the slab, $E_s$ denotes the elastic modulus of the slab, $\nu_s$ denotes the Poisson's ratio of the slab, $2T_{inlet}$ denotes the inlet thickness of the slab, $2T_{gap}$ denotes the roller gap, $F_{back}$ denotes the back tension of the slab, R denotes the roller flattening radius, $\theta_{inlet}$ denotes the first angle corresponding to the distance from the inlet position of the inlet elastic compression zone to the roller centerline, θ denotes the first contact angle between the inlet position of the plastic deformation zone and the roller centerline, and $$P^e_{inlet}$$

may be calculated when the time t is determined.

In some embodiments, based on the roller flattening radius and the inclination angle of the transition zone, the first recovery height corresponding to any position of the outlet elastic recovery zone $2T_{xoutlet}$ is determined using Equation (50):

$$T_{xoutlet}=[x-(x_0-l_{outlet})]\tan\gamma+T_{outlet}=[x-(R\cos 0.4775°-l_{outlet})]\tan 0.477°+(2.5+1.25t)\times10^{-3}m \tag{50}$$

In Equation (50), $x_0$ denotes the distance from the outlet position of the plastic deformation zone to the roller centerline, $x_0=R\cos\alpha_0$, $l_{outlet}$ denotes the projected contact arc length of the outlet elastic recovery zone in the rolling direction, γ denotes the inclination angle of the transition zone, and $2T_{outlet}$ denotes the outlet thickness of the slab. An expression for $T_{xoutlet}$ may be derived when the time t is determined.

In some embodiments, taking into account the effect of the front tension of the slab on the outlet elastic recovery zone, the rolling force $$P^e_{outlet}$$

of the outlet elastic recovery zone using Equation (51):

$$P^e_{outlet} = \frac{3.93\times10^9 R}{(T_{outlet} + T_{s2})}\{4[T_{outlet} - R - T_{gap} - (R\sin\alpha_0 - l_{outlet})\tan\gamma][\sin\alpha_0 - \sin(\alpha_0 - \theta_{outlet})] + 2R\tan\gamma[\sin^2\alpha_0 - \sin^2(\alpha_0 - \theta_{outlet})] + R[2\theta_{outlet} + \sin 2\alpha_0 - \sin(2\alpha_0 - 2\theta_{outlet})]\} + \frac{7.39\times10^3 R}{T_{outlet}}[\sin\alpha_0 - \sin(\alpha_0 - \theta_{outlet})]N \tag{51}$$

In Equation (51), 2w denotes the width of the slab, R denotes the roller flattening radius, $l_{front}$ denotes the projected contact arc length of the outlet elastic recovery zone in the rolling direction, $2T_{outlet}$ denotes the outlet thickness of the slab, $\alpha_0$ denotes the angle corresponding to the distance from the outlet position of the plastic deformation zone to the roller centerline, γ denotes the inclination angle of the transition zone, $\theta_{outlet}$ denotes the angle corresponding to the outlet elastic recovery zone, $2T_{gap}$ denotes the roller gap. When the time t is determined, the value of $P^e_{outlet}$ may be calculated.

In operation 140, based on the characteristics of the non-steady-state process during cold rolling thickness increase and the condition of the invariance of the volume of the material, as well as the rotation velocity of the rollers and the neutral angle, the inlet unit flow rate U of the slab per second is determined using Equation (52):

$$U=wv_0T_{s1}=2\pi nR_0w\cos\alpha_n(T_{s1}+R\cos\theta-R\cos\alpha_n)+VRw(\theta-\alpha_n)=2.400\times10^{-3}\pi\cos\alpha_n(T_{s1}+R\cos\theta-R\cos\alpha_n)+6.25\times10^{-5}R(\theta-\alpha_n) \quad (52)$$

In Equation (52), 2w denotes the width of the slab, $v_0$ denotes the inlet velocity of the slab, n denotes the rotation velocity of the roller, $R_0$ denotes the original roller flattening radius, R denotes the roller flattening radius, $2T_{s1}$ denotes the inlet thickness of the plastic deformation zone, θ denotes the first contact angle between the inlet position of the plastic deformation zone and the roller centerline, $\alpha_n$ denotes the neutral angle, which is a constant that varies with the parameters of the rolling process, and the inlet unit flow rate U of the slab per second may be determined when the time t is determined.

In some embodiments, based on the characteristics of the non-steady-state process during cold rolling thickness increase, the average compression rate $\bar{\varepsilon}$ of the slab is calculated using Equation (53), then the average compression rate $\bar{\varepsilon}$ of the slab is substituted into the deformation resistance model to obtain the average deformation resistance $\bar{\delta}_s$ using Equation (54):

$$\bar{\varepsilon}=\frac{T-T_{inlet}}{3T}+\frac{2(T-T_{outlet})}{3T}=\frac{[3.5-1.25t]}{9} \quad (53)$$

$$\bar{\delta}_s=A_0\left[\frac{T-T_{inlet}}{3T}+\frac{2(T-T_{outlet})}{3T}\right]^{A_1}-0.125\left(\frac{F_{back}}{T_{inlet}w}+\frac{F_{front}}{T_{outlet}w}\right)=277\left(\frac{3.5-1.25t}{9}\right)^{0.1563}-0.125\left(100+\frac{600}{2.5+1.25t}\right)Mpa \quad (54)$$

In Equations (53) and (54), 2T denotes the original thickness of the slab, $2T_{inlet}$ denotes the inlet thickness of the slab, $2T_{outlet}$ denotes the outlet thickness of the slab, 2w denotes the width of the slab, $F_{front}$ denotes the front tension of the slab, $F_{back}$ denotes the back tension of the slab, $A_0$ and $A_1$ are nonlinear regressive coefficients, which are related to the material's properties. When the time t is determined, the values of $\bar{\varepsilon}$ and $\bar{\delta}s$ may be calculated.

In some embodiments, the regional powers in the non-steady-state process of cold rolling thickness increase is calculated based on the velocity field, the inlet unit flow rate of the slab per second, and the average deformation resistance, thereby obtaining the total power functional $W_{total}$:

$$W_{internal}=\frac{4\pi}{3\sqrt{3}}\bar{\delta}_s U\left[\frac{1}{\lambda}\frac{T_{s2}}{T_{s1}}\sinh\left(\lambda\frac{T_{s2}-T_{s1}}{T_{s1}}\right)-\frac{2}{\lambda^2}\cos\left(\lambda\frac{T_{s1}-T_{s2}}{T_{s1}}\right)-1+\frac{T_{s2}}{T_{s1}}+\frac{2}{\lambda^2}\right]+\frac{8\pi w^2}{3\sqrt{3}}\bar{\delta}_s VR\left[(\theta-\overline{\psi}_m)\ln\left(\frac{T_{s1}}{T_{s2}}\right)+\theta-\alpha_0\right] \quad (55)$$

The tension power $W_{tension}$ of the slab is determined using Equation (56):

$$W_{tension}=\frac{U}{w}\left(\frac{F_{back}}{T_{inlet}}-\frac{F_{front}}{T_{outlet}}\right)+\frac{VRF_{front}(\theta-\alpha_0)}{T_{outlet}} \quad (56)$$

The friction power $W_{friction}$ between the slab and the rollers is determined using Equation (57):

$$W_{friction}=\frac{8\bar{\delta}}{\sqrt{3}}wf\Bigg\{2\pi nR_0R(\theta-2\alpha_n+\alpha_0)+VR(\cos\theta-2\cos\alpha_n+\cos\alpha_0)+\frac{UR}{wT_{s1}}\ln\left(\frac{\tan^2\left(\frac{\alpha_n}{2}+\frac{\pi}{4}\right)}{\left(\tan\left(\frac{\alpha_0}{2}+\frac{\pi}{4}\right)\tan\left(\frac{\theta}{2}+\frac{\pi}{4}\right)\right)}\right)+\frac{RQ_f}{\lambda}\frac{2U}{wT_{s1}}\left[\operatorname{atanh}\left(\tan\frac{\alpha_n}{2}\right)-\operatorname{atanh}\left(\tan\frac{\alpha_0}{2}\right)\right]-\frac{RQ_b}{\lambda}\frac{2U}{wT_{s1}}\left[\operatorname{atanh}\left(\tan\frac{\theta}{2}\right)-\operatorname{atanh}\left(\tan\frac{\alpha_n}{2}\right)\right]+VR\ln\frac{\cos^2\alpha_n}{\cos\theta\cos\alpha_0}+\frac{2VR(\overline{\psi}_m-\theta)}{M\sqrt{M^2-1}}\times\left\{2\arctan\left[\sqrt{\frac{M+1}{M-1}}\tan\left(\frac{\alpha_n}{2}\right)\right]-\arctan\left[\sqrt{\frac{M+1}{M-1}}\tan\left(\frac{\alpha_0}{2}\right)\right]-\arctan\left[\sqrt{\frac{M+1}{M-1}}\tan\left(\frac{\theta}{2}\right)\right]+\frac{\sqrt{M^2-1}}{2}\ln\frac{\tan^2\left(\frac{\pi}{4}+\frac{\alpha_n}{2}\right)}{\tan\left(\frac{\pi}{4}+\frac{\alpha_0}{2}\right)\tan\left(\frac{\pi}{4}+\frac{\theta}{2}\right)}\right\}\Bigg\} \quad (57)$$

The shear power of the rollers on the slab $W_{shear}$ is determined using Equation (58):

$$W_{shear}=\frac{2\bar{\delta}_s}{\sqrt{3}}U\tan\theta-\frac{2\bar{\delta}_s wT_{s1}VR\tan\theta}{\sqrt{3}\,l_{plastic}}+\frac{2\bar{\delta}_s}{\sqrt{3}}wT_{s2}\tan\alpha_0\sqrt{\left\{\frac{U}{wT_{s1}}\left[1+\frac{1}{\lambda}\sinh\left(\lambda\frac{T_{s1}-T_{s2}}{T_{s1}}\right)\right]-\left[\frac{VR(\theta-\alpha_0)}{T_{s2}}+\frac{VR}{x_0}\right]\right\}^2+\left(\frac{U}{T_{s1}}\right)^2\left\{\frac{1}{T_{s1}}\cosh\left(\lambda\frac{T_{s1}-T_{s2}}{T_{s1}}\right)-\frac{1}{T_{s2}}\left[1+\frac{1}{\lambda}\sinh\left(\lambda\frac{T_{s1}-T_{s2}}{T_{s1}}\right)\right]\right\}^2} \quad (58)$$

The internal deformation power $W_{internal}$ of the slab is determined using Equation (55):

In Equation (55) to Equation (58), $\bar{\delta}_s$ denotes the average deformation resistance of the slab, U denotes the inlet unit flow rate of the slab per second, A is an undetermined parameter, which may be obtained according to a relationship between inlet flow and outlet flow, $2T_{s1}$ denotes the inlet thickness of the plastic deformation zone, $2T_{s2}$ denotes the outlet thickness of the plastic deformation zone, 2w denotes the width of the slab, V denotes the vertical velocity of the rollers, R denotes the roller flattening radius, θ denotes the first contact angle between the inlet position of the plastic deformation zone and the roller centerline, $\overline{\psi}_m$ is the average value of contact angles of the deformation zone, $$\overline{\psi}_m = \frac{\int_{\alpha_0}^{\theta} \alpha R \cos \alpha d\alpha}{R \sin \theta - R \sin \alpha_0}.$$

$\alpha_0$ denotes the angle corresponding to the distance from the outlet position of the plastic deformation zone to the roller centerline, $l_{plastic}$ denotes the distance from the inlet position of the plastic deformation zone to the roller centerline, $x_0$ denotes the distance from the outlet position of the plastic deformation zone to the roller centerline, f denotes the coefficient of friction between the rollers and the slab, n denotes the rotation velocity of the rollers, $\alpha_n$ denotes the neutral angle, M is a parameter related to the roller flattening radius and the thickness of the deformation zone, $$M = \frac{T_{s1}}{R} + \cos \theta,$$

$Q_f$ is a parameter related to the thickness of the front slip zone, $$Q_f = \sinh\left[\lambda\left(1 - \frac{T_{\alpha_n} + 2T_{s2}}{3T_{s1}}\right)\right],$$

$$Q_b = \sinh\left[\lambda\left(1 - \frac{T_{s1} + T_{\alpha_n}}{3T_{s1}}\right)\right],$$

$Q_b$ is a parameter related to the thickness of the rear slip zone, $F_{front}$ denotes the front tension of the slab, $F_{back}$ denotes the back tension of the slab. When the time t is determined, the formula for the regional powers with respect to the neutral angle may be obtained.

In some embodiments, a minimum value of the total power functional at any time t is calculated. Based on the relationship between the total power functional and the rolling force, the rolling force $P_{plastic}$ in the plastic deformation zone at any time t is determined:

The total power functional $W_{total}$ is determined using Equation (59):

$$W_{total} = W_{internal} + W_{shear} + W_{friction} + W_{tension} \tag{59}$$

The total power functional is differentiated and the differentiation result is set to be equal to zero to obtain a neutral angle $\alpha_n$ when the total power functional is minimized:

$$\frac{dW_{total}}{d\alpha_n} = 0 \tag{60}$$

The obtained an is substituted into Equations (55), (57), and (58) to calculate the values of $W_{internal}$, $W_{friction}$, and $W_{shear}$. Then the rolling force of the plastic deformation zone is calculated based on these values using Equation (61):

$$P_{plastic} = \frac{(W_{internal} + W_{friction} + W_{shear})}{1.6\pi n\sqrt{2R(T_{s1} - T_{gap}) - (T_{s1} - T_{gap})^2}} \tag{61}$$

In Equation (59) to Equation (61), $W_{internal}$ denotes the internal deformation power of the slab, $W_{friction}$ denotes the friction power between the slab and the roller, $W_{shear}$ denotes the shear power of the rollers on the slab, $W_{tension}$ denotes the tension power of the slab, an denotes the neutral angle, n denotes the rotation velocity of the roller, $2T_{s1}$ denotes the inlet thickness of the plastic deformation zone, $2T_{gap}$ denotes the roller gap, and the value of $P_{plastic}$ may be determined when the time t is determined.

In operation 150, the rolling forces $$P^e_{inlet},$$

$$P^e_{outlet},$$

and $P_{plastic}$ are summed to obtain the total rolling force $P_{total}$, and based on the coupling relationship between the rolling force and the roller flattening radius, the rolling force that satisfies the predetermined convergence condition is calculated by iterative operations.

The roller flattening radius R is determined based on the coupling relationship between the rolling force and the roller flattening radius using the following equations:

$$R = R_0\left[1 + \frac{1.7 \times 10^{-12}}{\pi w} \frac{P_{total}}{\left(\sqrt{T_{inlet} - T_{gap} + \Delta T_t} - \sqrt{T_{outlet} - T_{gap}}\right)^2}\right] \tag{62}$$

$$\Delta T_t = \frac{v_s(1 + v_s)(F_{back} + F_{front})}{4wE_s} \tag{63}$$

The predetermined convergence condition may be expressed by Equation (64):

$$\frac{|R_i - R_{i-1}|}{R_i} \leq 0.01 \tag{64}$$

In Equation (62) to Equation (64), $$P^e_{inlet}$$

denotes the rolling force of the inlet elastic compression zone, $P_{plastic}$ denotes the rolling force of the plastic deformation zone, $$P^e_{outlet}$$

denotes the rolling force of the outlet elastic recovery zone, R denotes the roller flattening radius, $R_0$ denotes the original roller flattening radius, 2w denotes the width of the slab, $2T_{inlet}$ denotes the inlet thickness of the slab, $2T_{gap}$ denotes the roller gap, $2T_{outlet}$ denotes the outlet thickness of the slab, $\Delta T_t$ denotes the effect of the front and back tensions on the roller flattening radius, $E_s$ denotes the elastic modulus of the slab, $v_s$ denotes the Poisson's ratio of the slab, $F_{front}$ denotes the front tension of the slab, $F_{back}$ denotes the back tension of the slab. When the time t is determined, the value of $$P'_{total}$$

may be derived. $R_i$ is a roller flattening radius in an $i^{th}$ iteration, $R_{i-1}$ is a roller flattening radius in a $(i-1)^{th}$ iteration. When i=1, $R_i$ is the roller flattening radius in the first iteration, $R_{i-1}$ is the original roller flattening radius. When i=5, $R_i$ is the roller flattening radius in the fifth iteration, and $R_{i-1}$ is the roller flattening radius in the fourth iteration.

In some embodiments, if a relationship between the roller flattening radius in the $i^{th}$ iteration and the roller flattening radius in the $(i-1)^{th}$ iteration satisfies the predetermined convergence condition, the calculated total rolling force $P_{total}$ is determined as the first total rolling force $$P'_{total}.$$

In operation 160, based on the first total rolling force $$P'_{total}$$

and the stiffness K of the rolling mill, the roller gap $S_{gap}$ taking into account of the stiffness of the rolling mill is determined using Equation (65):

$$S_{gap} = 2T_{gap} - \frac{P'_{total}}{K} = 2T_{gap} - \frac{P'_{total}}{4\times 10^6}\ \text{mm} \tag{65}$$

In the above equation, $S_{gap}$ denotes the roller gap when considering the stiffness of the rolling mill, $2T_{gap}$ denotes the roller gap, $$P'_{total}$$

denotes the first total rolling force, K denotes the stiffness of the rolling mill, and $$K = 4\times 10^6 \frac{N}{\text{mm}}.$$

In some embodiments, as shown in FIG. 4, the horizontal axis represents rolling time, and the vertical axis represents the total rolling force (unit in kilonewtons (kN)), and the " ⟿ " curve in the drawing represents model values determined using the method disclosed in the embodiments of the present disclosure, i.e., the values of the total rolling force. The " ⟿ " curve represents experimental measured values of the total rolling force. It may be seen from FIG. 4 that the agreement between the values obtained using the method of the present disclosure and the measured values is very high, with the rolling force prediction accuracy exceeding 95%.

As shown in FIG. 5, the horizontal axis represents the rolling time, and the vertical axis represents the roller gap (unit in millimeters (mm)). The '◆' curve in the graph represents model calculation values determined using the method disclosed in the embodiments of the present disclosure, which correspond to the predicted values of the roller gap. The '▬' curve in the diagram represents experimental measured values of the roller gap. It may be seen from FIG. 5 that the agreement between the values obtained using the method of the present disclosure and the measured values is very high, with the roller gap prediction accuracy exceeding 98%.

In summary, through the method for predicting the roller gap in the non-steady-state process disclosed in the embodiments of the present disclosure, the prediction accuracy of the roller gap can be increased to more than 98%, thereby improving the accuracy of the shape and thickness of the product.

Figure 6:
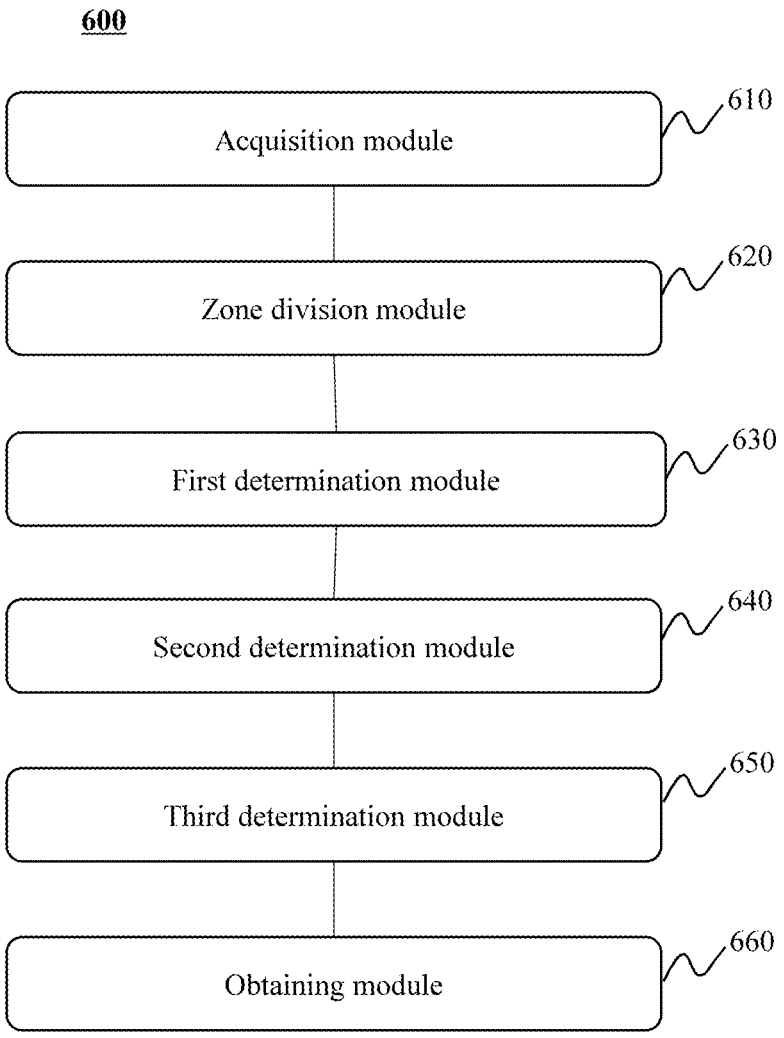
FIG. 6 is a block diagram of a device for predicting a roller gap in a non-steady-state process according to some embodiments of the present disclosure.

In some embodiments, the present disclosure also provides a device for predicting a roller gap in a non-steady-state process. Referring to FIG. 6. FIG. 6 is a block diagram of a device for predicting a roller gap in a non-steady-state process according to some embodiments of the present disclosure.

In some embodiments, as shown in FIG. 6, a device 600 for predicting a roller gap in a non-steady-state process includes an acquisition module 610, a zone division module 620, a first determination module 630, a second determination module 640, a third determination module 650, and an obtaining module 660.

In some embodiments, the device 600 may also include devices such as a terminal, a server, or the like. Some or all of the modules in the device 600 may be integrated into the server. In some embodiments, the device 600 is directly a rolling device, etc.

In some embodiments, the acquisition module 610 is configured to acquire a plurality of first rolling parameters.

In some embodiments, the zone division module 620 is configured to divide, based on the plurality of first rolling parameters, a rolling deformation zone into an inlet elastic compression zone, a plastic deformation zone, and an outlet elastic recovery zone using a predetermined rolling deformation zone division strategy.

In some embodiments, the first determination module 630 is configured to determine, based on the plurality of first rolling parameters, a rolling force of the inlet elastic compression zone and a rolling force of the outlet elastic recovery zone through function calculations using a predetermined elastic mechanics calculation model.

In some embodiments, the second determination module 640 is configured to determine, based on the plurality of first rolling parameters and a predetermined velocity field in a non-steady-state process deformation zone, a rolling force of the plastic deformation zone through function calculations using a predetermined energy technique.

In some embodiments, the third determination module 650 is configured to determine, based on the rolling force of the inlet elastic compression zone, the rolling force of the outlet elastic recovery zone, the rolling force of the plastic deformation zone, and a coupling relationship between the rolling forces and a roller flattening radius, a first total rolling force of the non-steady-state process deformation zone that satisfies a predetermined convergence condition.

In some embodiments, the obtaining module 660 is configured to obtain, based on the plurality of first rolling parameters and the first total rolling force, the roller gap through function calculations using a first predetermined function model.

In some embodiments of the present disclosure, the device for predicting the roller gap in the non-steady-state process is proposed. The device obtains a plurality of first rolling parameters through the acquisition module and, based on the zone division module, using the predetermined rolling deformation zone division strategy to divide the rolling deformation zone. Further, the rolling force of the inlet elastic compression zone and the rolling force of the outlet elastic recovery zone are determined based on the first determination module. Then, the rolling force of the plastic deformation zone is determined using the second determination module. Additionally, the first total rolling force of the non-steady-state process deformation zone, which satisfies the predetermined convergence condition, is determined using the third determination module. Finally, based on the obtaining module, the roller gap in the non-steady-state process is determined based on the plurality of first rolling parameters and the first total rolling force. The prediction accuracy of the roller gap is improved to over 98%, significantly enhancing the accuracy of roller gap prediction in the non-steady-state process.

While the present disclosure is described in connection with specific features and embodiments thereof, it is obvious that various modifications and combinations thereof may be made without departing from the spirit and scope of the present disclosure. Obviously, those skilled in the art may make various modifications and variations of the present disclosure without departing from the spirit and scope of the present disclosure. Thus, if these modifications and variations of the present disclosure fall within the scope of the claims of the present disclosure and their equivalent technologies, the present disclosure is also intended to include these modifications and variations.

What is claimed is:

1. A method for predicting a roller gap in a non-steady-state process, executed by a terminal or a server, wherein the terminal includes a mobile device and a rolling device, the server is used for remotely controlling the rolling device, and the method comprises:

obtaining a plurality of first rolling parameters by a sensor, a thickness gauge, a velocity sensor, and an inverter;

dividing, based on the plurality of first rolling parameters, a rolling deformation zone into an inlet elastic compression zone, a plastic deformation zone, and an outlet elastic recovery zone using a predetermined rolling deformation zone division strategy;

determining, based on the plurality of first rolling parameters, a rolling force of the inlet elastic compression zone and a rolling force of the outlet elastic recovery zone through function calculations using a predetermined elastic mechanics calculation model;

determining, based on the plurality of first rolling parameters and a predetermined velocity field in a non-steady-state process deformation zone, a rolling force of the plastic deformation zone through function calculations using a predetermined energy technique;

determining a first total rolling force of the non-steady-state process deformation zone that satisfies a predetermined convergence condition based on the rolling force of the inlet elastic compression zone, the rolling force of the outlet elastic recovery zone, the rolling force of the plastic deformation zone, and a coupling relationship between the rolling forces and a roller flattening radius, including:

obtaining a total rolling force of the non-steady-state process deformation zone by summing the rolling force of the inlet elastic compression zone, the rolling force of the outlet elastic recovery zone, and the rolling force of the plastic deformation zone;

determining the roller flattening radius through a sixth predetermined function model based on the total rolling force of the non-steady-state process deformation zone and the plurality of first rolling parameters;

determining, based on a roller flattening radius in an $i^{th}$ iteration and a roller flattening radius in a $(i-1)^{th}$ iteration, whether a logical relationship between the roller flattening radius in the $i^{th}$ iteration and the roller flattening radius in the $(i-1)^{th}$ iteration satisfies the predetermined convergence condition;

in response to determining that the logical relationship between the roller flattening radius in the $i^{th}$ iteration and the roller flattening radius in the $(i-1)^{th}$ iteration satisfies the predetermined convergence condition, determining the total rolling force as the first total rolling force of the non-steady-state process deformation zone, wherein the roller flattening radius is determined through the following equation:

$$R = R_0\left[1 + \frac{1.7\times10^{-12}}{\pi w}\frac{P_{total}}{\left(\sqrt{T_{inlet} - T_{gap} + \Delta T_t} - \sqrt{T_{outlet} - T_{gap}}\right)^2}\right];$$

wherein $P_{total}$ denotes the total rolling force of the non-steady-state process deformation zone, R denotes the roller flattening radius, $R_0$ denotes an original roller radius, w denotes one-half of a width 2w of a slab, $T_{inlet}$ denotes one-half of an inlet thickness $2T_{inlet}$ of the slab, $T_{gap}$ denotes one-half of a roller gap $2T_{gap}$, $T_{outlet}$ denotes one-half of an outlet thickness $2T_{outlet}$ of the slab, and $\Delta T_t$ denotes an effect of a front tension and a back tension on the roller flattening radius; and obtaining, based on the plurality of first rolling parameters and the first total rolling force, the roller gap through function calculations using a first predetermined function model to optimize an adjustment of roller gap parameters, wherein the roller gap is a roller gap taking into account a stiffness of a rolling mill, and the first predetermined function model includes the following equation:

$$S_{gap} = 2T_{gap} - \frac{P'_{total}}{K}$$

wherein $S_{gap}$ denotes the roller gap taking into account the stiffness of the rolling mill, $2T_{gap}$ denotes the roller gap, $$P'_{total}$$

denotes the first total rolling force, and $$P'_{total}$$

denotes the stiffness of the rolling mill.

2. The method of claim 1, wherein prior to determining the rolling force of the inlet elastic compression zone, the method comprises:

determining, based on the plurality of first rolling parameters, a first angle between an inlet position of the inlet elastic compression zone and a roller centerline, and a first contact angle between the inlet position of the inlet elastic compression zone and the plastic deformation zone; and determining, based on the plurality of first rolling parameters, the first angle, and the first contact angle, the rolling force of the inlet elastic compression zone through a second predetermined function model.

3. The method of claim 1, wherein prior to determining the rolling force of the outlet elastic recovery zone, the method comprises:

determining a first recovery height corresponding to any position of the outlet elastic recovery zone based on a roller radius and an inclination angle of a transition zone; and determining, based on the plurality of first rolling parameters and the first recovery height, the rolling force of the outlet elastic recovery zone through a third predetermined function model.

4. The method of claim 1, wherein the predetermined velocity field in the non-steady-state process deformation zone includes a velocity field in the non-steady-state process deformation zone during cold rolling thickness increase, established based on a predetermined boundary condition; the predetermined boundary condition includes at least a velocity boundary condition of the non-steady-state process deformation zone, a volume invariance condition, and a velocity in a vertical direction of rollers.

5. The method of claim 4, wherein determining the plastic deformation zone through function calculations using the predetermined energy technique includes:

in response to determining that the velocity boundary condition and the volume invariance condition are satisfied, determining, based a rotation velocity of the rollers and a neutral angle, an inlet unit flow rate of the slab per second through a fourth predetermined function model.

6. The method of claim 5, wherein determining the plastic deformation zone through function calculations using the predetermined energy technique further includes:

determining, based on the plurality of first rolling parameters, the velocity field in the non-steady-state process deformation zone, the inlet unit flow rate of the slab per second, and an average deformation resistance, regional powers in the non-steady-state process deformation zone through a fifth predetermined function model, wherein the regional powers in the non-steady-state process deformation zone includes an internal deformation power of the slab, a shear power of the rollers on the slab, a friction power between the slab and the rollers, and a tension power of the slab;

obtaining a total power in the non-steady-state process deformation zone by summing the regional powers in the non-steady-state process deformation zone;

obtaining a value corresponding to the neutral angle by performing differentiation on the total power in the non-steady-state process deformation zone using the following equation:

$$\frac{dW_{total}}{d\alpha_n} = 0$$

wherein $W_{total}$ denotes the total power in the non-steady-state process deformation zone, and $\alpha_n$ denotes the neutral angle; and determining, based on the value corresponding to the neutral angle, a value corresponding to the power of each of the inlet elastic compression zone, the plastic deformation zone, and the outlet elastic recovery zone in the non-steady-state process using the fifth predetermined function model.

7. The method of claim 1, wherein the predetermined convergence condition includes:

$$\frac{|R_i - R_{i-1}|}{R_i} \leq 0.01$$

wherein $R_i$ denotes the roller flattening radius in the $i^{th}$ iteration, and $R_{i-1}$ denotes the roller flattening radius in the $(i-1)^{th}$ iteration.

8. A device for predicting a roller gap in a non-steady-state process, the device comprising:

a terminal, wherein the terminal includes a mobile device and a rolling device;

a server configured to remotely control the rolling device;

an acquisition module configured to obtain a plurality of first rolling parameters by a sensor, a thickness gauge, a velocity sensor, and an inverter;

a zone division module configured to divide, based on the plurality of first rolling parameters, a rolling deformation zone into an inlet elastic compression zone, a plastic deformation zone, and an outlet elastic recovery zone using a predetermined rolling deformation zone division strategy;

a first determination module configured to determine, based on the plurality of first rolling parameters, a rolling force of the inlet elastic compression zone and a rolling force of the outlet elastic recovery zone through function calculations using a predetermined elastic mechanics calculation model;

a second determination module configured to determine, based on the plurality of first rolling parameters and a predetermined velocity field in a non-steady-state process deformation zone, a rolling force of the plastic deformation zone through function calculations using a predetermined energy technique;

a third determination module configured to determine a first total rolling force of the non-steady-state process deformation zone that satisfies a predetermined convergence condition based on the rolling force of the inlet elastic compression zone, the rolling force of the outlet elastic recovery zone, the rolling force of the plastic deformation zone, and a coupling relationship between the rolling forces and a roller flattening radius, wherein to determine the first total rolling force of the non-steady-state process deformation zone that satisfies the predetermined convergence condition, the third determination module is further configured to:

obtain a total rolling force of the non-steady-state process deformation zone by summing the rolling force of the inlet elastic compression zone, the rolling force of the outlet elastic recovery zone, and the rolling force of the plastic deformation zone;

determine the roller flattening radius through a sixth predetermined function model based on the total rolling force of the non-steady-state process deformation zone and the plurality of first rolling parameters;

determine, based on a roller flattening radius in an $i^{th}$ iteration and a roller flattening radius in a $(i-1)^{th}$ iteration, whether a logical relationship between the roller flattening radius in the $i^{th}$ iteration and the roller flattening radius in the $(i-1)^{th}$ iteration satisfies the predetermined convergence condition;

in response to determining that the logical relationship between the roller flattening radius in the $i^{th}$ iteration and the roller flattening radius in the $(i-1)^{th}$ iteration satisfies the predetermined convergence condition, determining the total rolling force as the first total rolling force of the non-steady-state process deformation zone, wherein the roller flattening radius is determined through the following equation:

$$R = R_0\left[1 + \frac{1.7\times 10^{-12}}{\pi w}\frac{P_{total}}{\left(\sqrt{T_{inlet} - T_{gap} + \Delta T_t} - \sqrt{T_{outlet} - T_{gap}}\right)^2}\right]$$

wherein $P_{total}$ denotes the total rolling force of the non-steady-state process deformation zone, R denotes the roller flattening radius, $R_0$ denotes an original roller radius, w denotes one-half of a width 2w of a slab, $T_{inlet}$ denotes one-half of an inlet thickness $2T_{inlet}$ of the slab, $T_{gap}$ denotes one-half of a roller gap $2T_{gap}$, $T_{outlet}$ denotes one-half of an outlet thickness $2T_{outlet}$ of the slab, and $\Delta T_t$ denotes an effect of a front tension and a back tension on the roller flattening radius; and an obtaining module configured to obtain, based on the plurality of first rolling parameters and the first total rolling force, the roller gap through function calculations using a first predetermined function model to optimize an adjustment of roller gap parameters, wherein the roller gap is a roller gap taking into account a stiffness of a rolling mill, and the first predetermined function model includes the following equation:

$$S_{gap} = 2T_{gap} - \frac{P'_{total}}{K}$$

wherein $S_{gap}$ denotes the roller gap taking into account the stiffness of the rolling mill, $2T_{gap}$ denotes the roller gap, $$P'_{total}$$

denotes the first rolling force, and $$P'_{total}$$

denotes the stiffness of the rolling mill.

* * * * *